US011668190B2

(12) United States Patent
Walker et al.

(10) Patent No.: US 11,668,190 B2
(45) Date of Patent: Jun. 6, 2023

(54) MAGNETICALLY ISOLATING FEEDTHROUGH CONNECTOR

(71) Applicant: Halliburton Energy Services, Inc., Houston, TX (US)

(72) Inventors: Catriona Elizabeth Walker, Aberdeenshire (GB); Irvine Cardno Brown, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 105 days.

(21) Appl. No.: 17/451,135

(22) Filed: Oct. 15, 2021

(65) Prior Publication Data

US 2023/0119279 A1 Apr. 20, 2023

(51) Int. Cl.

| | |
|---|---|
| ***E21B 47/13*** | (2012.01) |
| ***E21B 47/01*** | (2012.01) |
| ***E21B 17/02*** | (2006.01) |

(52) U.S. Cl.

CPC ..... *E21B 47/13* (2020.05); *E21B 17/0285* (2020.05); *E21B 47/01* (2013.01)

(58) Field of Classification Search

None

See application file for complete search history.

(56) References Cited

U.S. PATENT DOCUMENTS 3,713,334 A * 1/1973 Vann ..... E21B 43/119 166/241.6

2008/0053654 A1* 3/2008 Ullah ..... E21B 47/135 166/250.1

2013/0126237 A1 5/2013 Burton et al.

(Continued)

FOREIGN PATENT DOCUMENTS

| | | | | |
|---|---|---|---|---|
| CA | 2746081 A1 * | 12/2009 | ..... | E21B 47/0905 |
| CN | 1975106 A * | 6/2007 | ..... | E21B 47/01 |
| CN | 109577896 | 4/2019 | | |

(Continued)

OTHER PUBLICATIONS

CN-1975106-A English Language Translation (Year: 2007).*

"PCT Application No. PCT/US2021/071919, International Search Report and Written Opinion", dated Jul. 4, 2022, 11 pages.

*Primary Examiner* — Curtis A Kuntz

*Assistant Examiner* — Jerold B Murphy

(74) *Attorney, Agent, or Firm* — Delizio, Peacock, Lewin & Guerra

(57) ABSTRACT

A bulkhead connector configured to be positioned within a tool body of a completion or intervention tool for use in a wellbore, and to provide a pressure and fluid seal between an area or a compartment within the tool body where one or more downhole tools are located and any fluid(s) present in the wellbore. The bulkhead connector includes one or more electrical switches positioned on the "low pressure" or tool side of the bulkhead connector, the electrical switches configured to be actuated by magnetic force(s) provided by one or more magnetic elements positioned on the "high pressure" or fluid side of the bulkhead connector. The bulkhead connector including electrical contact(s) that extend through the bulkhead connector that may be connected and disconnected from leads utilizing the magnetic force(s) provided from the fluid side of the bulkhead connector.

19 Claims, 16 Drawing Sheets

(56) References Cited

U.S. PATENT DOCUMENTS

| | | | | |
|---|---|---|---|---|
| 2015/0047854 | A1* | 2/2015 | Hradecky | E21B 33/0385 166/65.1 |
| 2021/0226376 | A1 | 7/2021 | Wolfe et al. | |

FOREIGN PATENT DOCUMENTS

| | | | | |
|---|---|---|---|---|
| WO | WO-2014094163 | A1 * | 6/2014 | E21B 33/0385 |
| WO | 2019226642 | | 11/2019 | |

* cited by examiner

MAGNETICALLY ISOLATING FEEDTHROUGH CONNECTOR

TECHNICAL FIELD

The disclosure generally relates to the testing and deployment of one or more downhole tools, and in particular to powering and/or communicating with the one or more downhole tools as provided in a sealed compartment prior to deployment of the tool(s) into a wellbore.

BACKGROUND

In many downhole electromechanical tools, it is necessary to turn on and communicate with one or more of the tools prior to running the tools downhole and operating the tools within the wellbore. This is normally achieved via an on/off switch and connection port located somewhere in the tool where access is gained for a computer to be communicatively coupled to the one or more tools for communication purposes. These switches and communication ports are typically not rated to the high pressures that may be experienced downhole in an oil well, and therefore may need to be housed within a high-pressure cover fitted with seals that prevent well fluid from entering the connector, the cover installed after uphole testing and communications with the tool(s) have been completed and prior to deployment of the tools downhole. These seals for the high-pressure cover must be pressure tested before deployment of the tool downhole, which can cause delays due to the requirements for test permits, pressure test equipment, and personnel offshore. Further, well fluids, such as brine, are very electrically conductive, which can cause issues of current leakage or short circuits as well as corrosion of electrical contacts used to provide these communications with the tools.

BRIEF DESCRIPTION OF THE DRAWINGS

Embodiments of the disclosure may be better understood by referencing the accompanying drawings.

Figure 1:
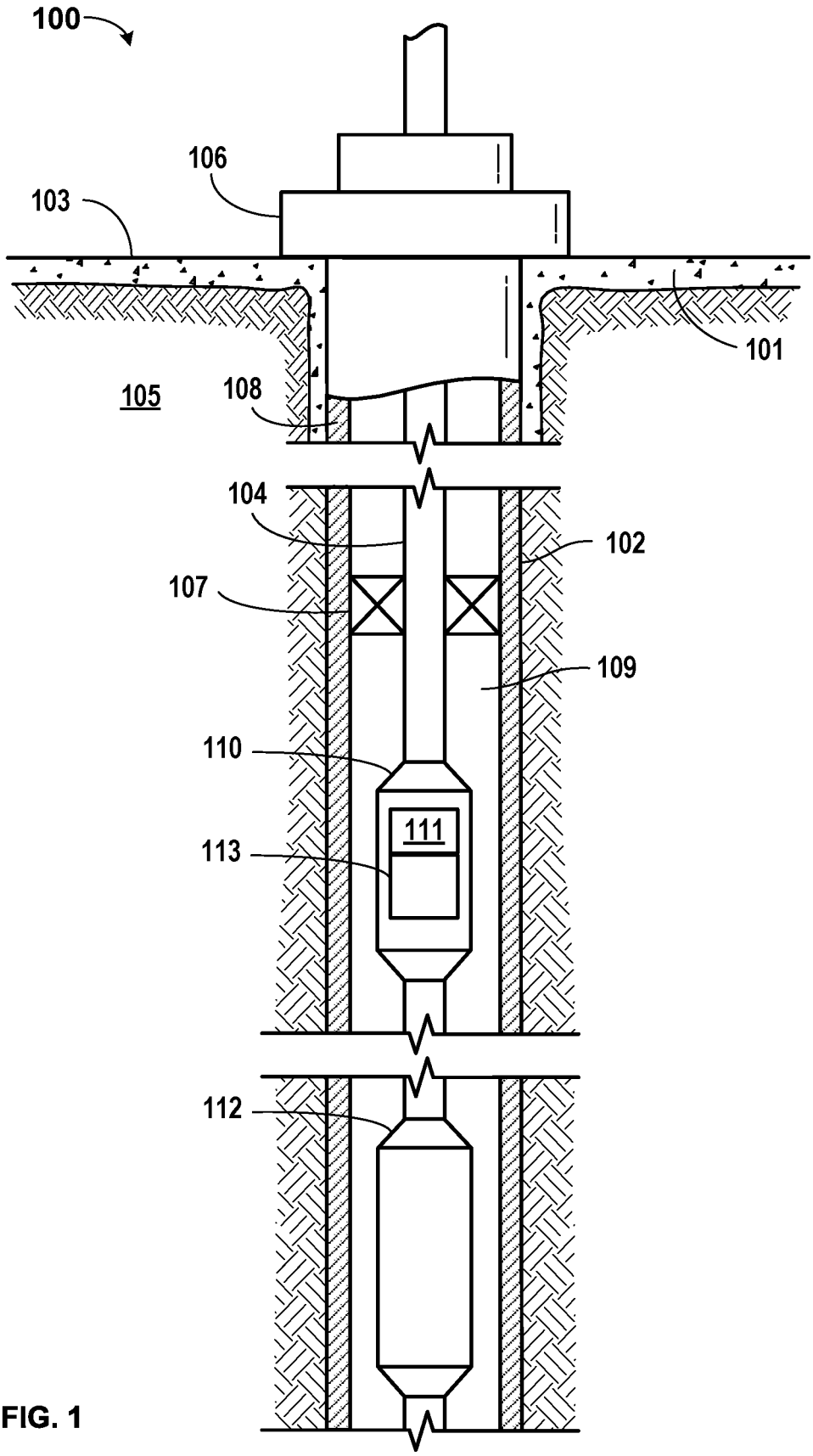
FIG. 1 depicts a partial cross-sectional view of an example well completion, according to one or more embodiments.

The drawings are provided for the purpose of illustrating example embodiments. The scope of the claims and of the disclosure are not necessarily limited to the systems, apparatus, methods, or techniques, or any arrangements thereof, as illustrated in these figures. In the drawings and description that follow, like parts are typically marked throughout the specification and drawings with the same or coordinated reference numerals. The drawing figures are not necessarily to scale. Certain features of the invention may be shown exaggerated in scale or in somewhat schematic form, and some details of conventional elements may not be shown in the interest of clarity and conciseness.

DESCRIPTION OF EMBODIMENTS

The description that follows includes example systems and methods that describe embodiments of the disclosure. However, it is understood that this disclosure may be practiced without some of these specific details. In other instances, well-known instruction instances, protocols, structures, and techniques have not been shown in detail in order not to obfuscate the description.

Overview

Once a downhole tool, e.g., one used in a well completion, has been pressure sealed and the pressure seal tested, further testing of functionality of the tool, i.e., by powering up the tool and communicating thereto, can be performed without breaking the pressure seal using embodiments of the feed-through connector as described in this disclosure. As will be disclosed herein, a bulkhead with a magnetic switch for power, and one or more magnetic switches for communication, form a pressure barrier for low pressure tool components. The bulkhead can have a slot or receptacle to receive a mating connector having a magnetic element, such as a magnet, disposed on the high pressure side of the bulkhead to activate the power switch, e.g., connecting one or more batteries into the tool to power circuitry therein, without breaking the pressure seal. Similarly, a communication ring (comm ring) having one or more magnets can be disposed on the bulkhead, connect to one or more pins in the bulkhead, and switch on the one or more communication switches (comm switches) to enable communication through the bulkhead without breaking the pressure seal. This allows the downhole tool to be powered up and communication to pass thereto, e.g., to test various functionality, all without breaking the pressure seal. Further, as the magnetic switches are on the inside of the bulkhead, the arrangement can avoid risks of shorts and corrosion to electrical components, including the switches themselves.

Various embodiments described in this disclosure comprise of an electrical feed through bulkhead connector which consists of a high pressure side (outside the area where the downhole tool(s) are located) and a low pressure side (inside the area or compartment where the downhole tool(s) are located), and in various embodiments has two electrical connection arrangements. A center electrical connection arrangement is configured to switch on the tool(s), and an outer ring arrangement is configured to allow communicate with the tool or other electronic devices, such as a processor/memory, positioned on the low pressure side of the bulkhead connector. The switching and communicating mechanisms are positioned on the low pressure side of the bulkhead connector. Operation of these switches is performed from outside of the low pressure side of the bulkhead connector, in various examples using one or more magnets. By attaching a magnet to a center portion on the high pressure side of the bulkhead, a power switch may be activated that is wired to switch on the electrical power to the tool(s), and the magnet is configured to stay in place for the tool(s) to remain switched on.

Communication with the tool(s) is achieved via the outer ring connections (located on a comms connector), which plugs into contacts on the outside of the tool also and includes magnets to operate communication switches located on the low pressure side of the bulkhead connector. Once communication with the tool(s) or other electronic devices located on the low pressure side of the bulkhead connector has been completed, the comms connector is removed and internal connections through the communication switches broken. The removal of the comms connector and the opening of the communication switches breaks the electrical connections between devices on the low pressure side of the bulkhead connector and any communication pins that extend through the bulkhead connector to the high pressure side of the bulkhead connector, so that the exposed pins on the high pressure side of a downhole tool can be exposed to conductive well fluid without the risk of causing a short circuit or current leak in the electronics located on the low pressure side of the bulkhead connector. Once this arrangement including the downhole tool(s) have been sealed into an area or a compartment within tool body using the bulkhead connector as a pressure/fluid barrier, the assembly can be pressure tested as part of the tool build and test procedure. This test only has to be carried out the one time and does not need to be repeated in the field.

In the field and during deployment of the tool body downhole, the bulkhead connector, the mating connector used to actuate the power switch powering the tools, and any pins extending through the bulkhead connector to the high pressure side of the bulkhead connector can be physically protected by a non-pressure retaining cap (i.e., an end sub), which can be placed over the exposed portions of the bulkhead connector without the need to test for or provide a fluid pressure seal to otherwise protect the portions of the bulkhead connector exposed on the high pressure side of the bulkhead. The end sub that covers the electrical connector does not require O-ring seals to prevent well fluid from entering and therefore pressure testing is not required every time communication is needed with the tool before deployment. This saves time, mobilization of testing equipment to the field operation, organizing a work to permit for the pressure test, and removes the associated danger of pressure testing in the field. The design would also be highly configurable, allowing additional modules to be connected to the tool, such as a Bluetooth module for wireless communication that does not require a wired connection in bulkhead connector, as the bottom sub can be removed and refitting in seconds.

Example Illustrations

FIG. 1 depicts a partial cross-sectional view of an example well completion 100, according to one or more embodiments. Well completion 100 includes a wellbore 102 extending through, i.e., formed in, a subterranean formation 105 from a wellhead 106 located at a surface 103 (i.e., the earth's surface). Although not depicted as such, the wellhead 106 could be a subsea wellhead located where the wellbore 102 intersects a sea floor. The wellbore 102 includes a casing 108 (e.g., a casing string). The casing 108 does not necessarily extend the full length of the wellbore 102. The casing 108 can be at least partially cemented into the subterranean formation 105, e.g., via one or one or more layers of cement 101. Although the cement 101 is shown near the surface 103, in one or more embodiments the cement 101 can extend the length of the wellbore 102. Although the wellbore 102 is depicted as a single vertical wellbore, other implementations are possible. For example, the wellbore 102 can include one or more deviated or horizontal portions. Although only one casing 108 is shown, multiple casing strings may be radially and/or circumferentially disposed around the casing 108.

A production or tubing string 104 can be positioned in the wellbore 102 inside the casing 108, forming an annulus 109 between the tubing string 104 and the casing 108. A hanger (not pictured) can be attached to the casing 108 to isolate the annulus 109. A packer 107 can be disposed on the tubing string 104 to centralize the tubing string 104 within the casing 108 and isolate the lower annulus. FIG. 1 depicts the tubing string 104 as including a first completion sub 110 and a second completion sub 112. Completion sub 110 and completion sub 112 can be physically coupled to the tubing string 104. Although two completion subs are shown, in some embodiments, the tubing string 104 may include only one completion sub or, alternatively, more than two completion subs. The first completion sub 110, the second completion sub 112, and the tubing string 104, collectively (possibly with other subs and joined tubing), make up the production tubing of the well completion 100. In one or more embodiments, the first completion sub 110 includes a magnetically isolating feedthrough connector (connector) 111. In one or more embodiments, the first and/or second completion sub(s) 110/112 can be a completion tool(s). Completion tool(s) as used herein refer to tools that screw onto tubing. In one or more embodiments subs 110 and/or sub 112 may be intervention tools. Intervention tools as used herein refer to tools that may be run inside tubing, in come embodiments on a temporary basis. Although referred to using the term "completion sub" throughout this disclosure, subs 110 and 112 may also refer to intervention tools. Alternatively or in addition, connector 111 may be incorporated into an intervention tool to be run inside the tubing string 104 once the tubing string 104 is positioned within the wellbore 102.

In various embodiments, connector 111 includes one or more seals that provide a pressure seal for a compartment 113 (e.g., a cavity), provided within the first completion sub 110 where one or more downhole tools are located. The one or more seals provide a pressure seal configured to prevent and protect the compartment 113 where the one or more downhole tools are located from being exposed fluids and to levels of fluid pressure, such as production fluid pressure, which may be present outside the compartment once the completion sub 110 is deployed downhole and/or is operating within wellbore 102. As further described below, connector 111 also includes one or more electrical connectors that extend through the connector, providing electrical connections between the one or more downhole tools located within the compartment 113 and areas outside of the compartment. These electrical connections may be used to couple to other devices located external to compartment 113 and configured to provide test indications and/or allow for electrical communications with the one or more tools located within compartment 113 prior to deployment of the completion sub 110 into wellbore 102, all conducted after the seals included as part of connector 111 have been pressure tested to confirm that they are providing the required level of pressure sealing for the compartment. In various embodiments, connector 111 includes a power switch configured to allow switching "ON" and "OFF" of the one or more tools located in compartment 113, and providing connections to one or more devices external to compartment 113 in order to communicate with and/or provide visual indication(s) related to the operating status of the one or more tools located within compartment 113, for example prior to deployment of the completion sub 110 into the wellbore 102 and after the seals of connector 111 have been positioned within the completion sub and pressure tested.

Figure 2B:
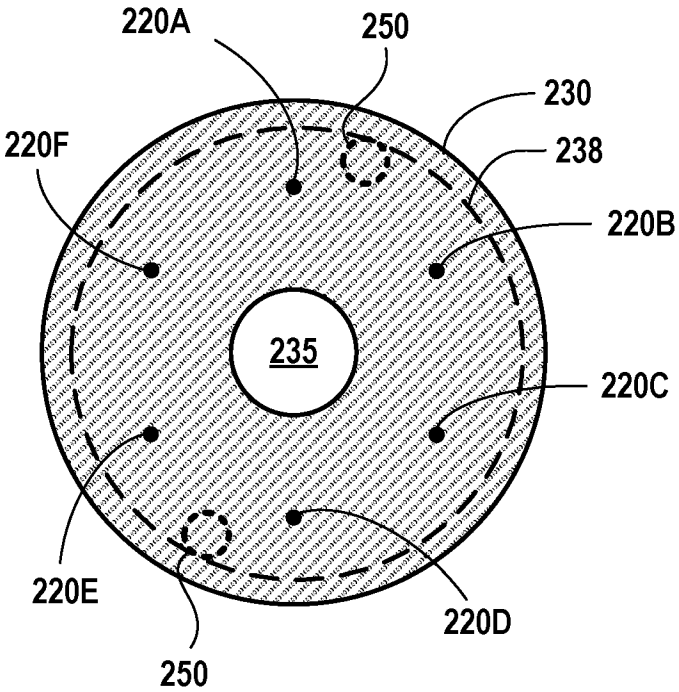
FIG. 2B depicts a second cross-sectional view of the first example bulkhead portion along the line 2B-2B, according to one or more embodiments.
Figure 2A:
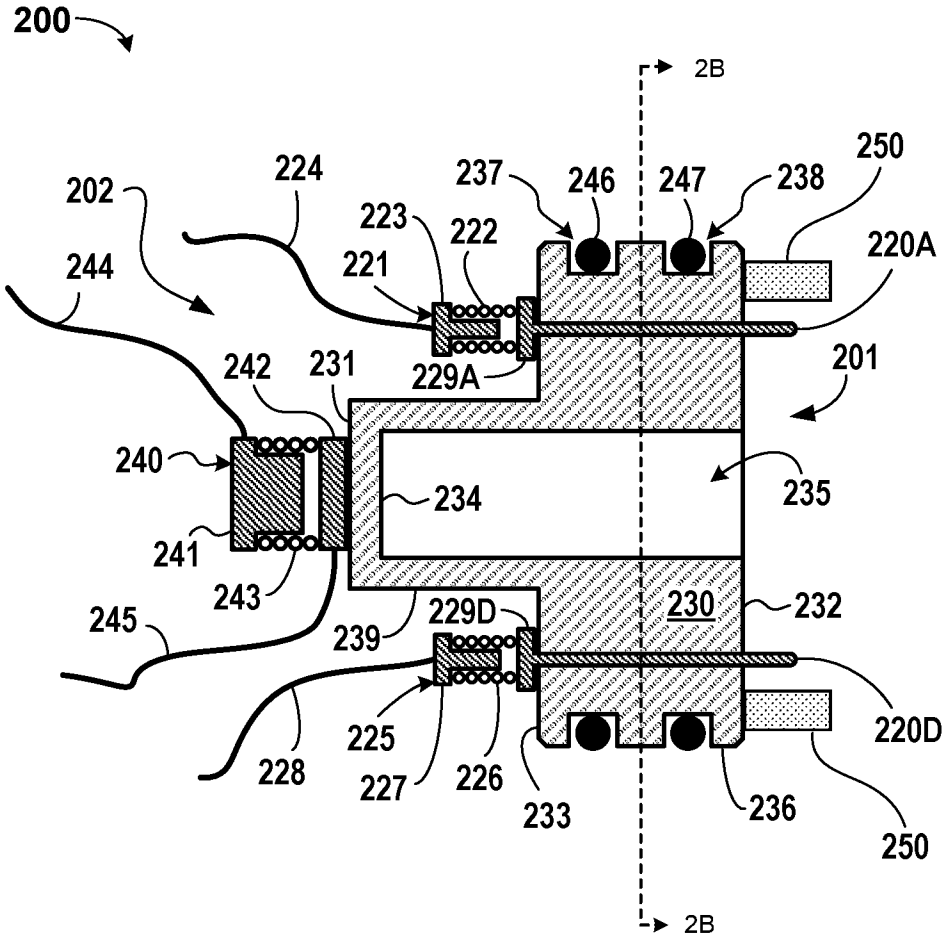
FIG. 2A depicts a first cross-sectional view of a first example bulkhead portion of a magnetically isolating feedthrough connector, according to one or more embodiments.

FIG. 2A depicts a first cross-sectional view of a first example bulkhead portion 200 of a magnetically isolating feedthrough connector, according to one or more embodiments. In various embodiments, the magnetically isolating feedthrough connector illustrated in FIG. 2A may be connector 111 as illustrated and described above with respect to FIG. 1

Referring back to FIG. 2A, the first example bulkhead portion 200 includes a bulkhead 230, two or more pins (two pins, a first pin 220A and a fourth pin 220D are shown), two or more communication switches (a first communication switch 221 and a second communication switch 225 are shown), and a power switch 240. The bulkhead 230 can have two sides, a first side 201 and a second side 202, each facing opposite directions, i.e., a first direction and a second direction, respectively. First side 201 of the bulkhead 230 is configured to be exposed to higher levels of fluid pressures, such as fluid pressures present within the wellbore when a completion or intervention tool that includes bulkhead 230 is deployed and/or is operating within a wellbore. Second side 202 of bulkhead 230 is configured to be adjacent to area(s), such as compartment 113 as illustrated and described with respect to FIG. 1, which are hydraulically sealed from and protected from being exposed to the fluid pressure(s) present in areas adjacent to first side 201 by one or more sealing devices, as further described below.

Referring again to FIG. 2A, bulkhead 230 includes a first surface 231 facing in the first direction and a second surface 232 facing in the second direction. The first surface 231 can be connected to third surface 233 via a neck 239. The third surface 233 may also face the first direction. In one or more embodiments, the bulkhead 230 can have the shape of a long weld neck flange with a cap, the first surface 231, on top of the neck, i.e., the neck 239. For example, the third surface 233 can be a portion of the bulkhead 230 that is flanged out and the first surface 231 can be a cover of the neck 239. The first surface 231 and the third surface 233 can face substantially in the first direction, i.e., they can generally be perpendicular to the first direction, but not necessarily exactly at a 90° angle with the first direction. For example, the first surface 231 or the third surface 233 can have as much as a 20° or less angle difference from the first direction. Likewise, the second surface 232 can face substantially in the second direction, i.e., they can generally be perpendicular to the second direction, but not necessarily exactly at a 90° angle with the second direction. For example, the second surface 232 could have as much as a 20° or less angle difference from the second direction.

A slot 235 can be formed in the bulkhead 230. FIG. 2A depicts the slot 235 as extending from the second surface 232 to a fourth surface 234. The fourth surface 234 can face in the second direction or substantially in the second direction. The slot 235 (and/or the fourth surface 234) can be centered or substantially centered with the first surface 231. In one or more embodiments, the first surface 231 and the fourth surface 234 are opposite one another. In addition, a sidewall 236 of the bulkhead 230 can include one or more recesses (two are shown: a first recess 237 and a second recess 238). Each recess can provide space for a seal, such as one or more O-rings and/or metal seals, to provide sealing for the bulkhead 230 within a tool body. As shown, a first O-ring 246 is disposed in the first recess 237 and a second O-ring 247 is disposed in the second recess 238. Although two recesses and two O-rings are shown, there could be only one recess in the sidewall 236 with one O-ring or there could be more than two recess in the sidewall 236 with more than two O-rings. Although not shown, instead of O-rings, a metal-to-metal seal could be used, i.e., without any O-rings.

The two or more pins 220A and 220D can be disposed through the bulkhead 230 and can protrude from the second surface 232. For example, the two or more pins 220A and 220D can extend from the third surface 233 through the bulkhead 230 and protrude from the second surface 232. In one or more embodiments, the two or more pins 220A and 220D may extend parallel with the slot 235. As depicted, the first pin 220A and the fourth pin 220D extend from the third surface 233 and protrude through the second surface 232. The two or more pins 220A and 220D can each have a pin head that is disposed on the third surface 233. For example, as shown, a first pin head 229A and a fourth pin head 229D are disposed on the third surface 233. In one or more embodiments, the two or more pins 220A and 220D may be molded into the bulkhead 230. Pins 220A and 220D may be configured to be coupled to one or more devices, such as comms connector 790 (FIG. 7A), in order to provide electrical connections through the bulkhead 230. In various embodiments, one or more orientation pins 250 may extend away from second surface 232. Orientation pin(s) 250 may be configured to engage one or more corresponding notches (such as notches 750, FIG. 7A) in order to allow proper orientation, and thus the correct electrical connections, to be made to pins 220A, 220A and any additional pins included in bulkhead 230 with the external devices that may be brought into physical contact and electrical connection with the pins such as pins 220A and 220D. In various embodiments, orientation pins 250 are configured so that the ends of orientation pins extend a distance that is farther from second surface 232 than a distance that the ends of pins 220A and 220D extend away from second surface 232 in order to assure the proper orientation, and thus the proper electrical connections, are being made to pins 220A, 220D, and any other pins extending through bulkhead 230 before any actual electrical connections via contact with the electrically conductive pins can be made. The number, shape, and relative orientation of the orientation pins 250 as shown in FIG. 2A is non-limiting and provided as an illustrative example, where different numbers, different shapes, and different relative arrangements of orientation pins and corresponding orientation notches could be utilized to perform the orientation function between the electrically conductive pins extend from the fluid side of the bulkhead and devices brought into physical and electrical coupling the electrically conductive pins.

The two or more communication switches can be electrically coupled to the two or more pins. For example, as shown, a first communication switch 221 is coupled to the first pin 220A, e.g., to the first pin head 229A, and a second communication switch 225 is coupled to the fourth pin 220D, e.g., to the fourth pin head 229D. In one or more embodiments, the two or more communication switches can comprise a terminal, a spring, and a comms lead. For example, the first communication switch 221 has a first terminal 223, a first spring 222, and a first comms lead 224 coupled to the first terminal 223, and the second communication switch 225 has a second terminal 227, a second spring 226, and a second comms lead 228 coupled to the second terminal 227.

In one or more embodiments, the two or more communication switches may default to an "OFF" or "open" position via a bias force provided by the respective springs. When the bias force of the springs is overcome, the two or more communication switches can shift to an "ON" or "closed" position, i.e., a position having an electrical pathway through the comms lead, the terminal, and a pin, e.g., via the pin head. For example, with respect to the first communication switch 221, when the bias force of the first spring 222 is overcome, the first terminal 223 can be brought into contact with the first pin head 229A, thereby creating an electrical pathway (e.g., for power and/or communication) between the first comms lead 224 and the first pin 220A. When the first terminal 223 is in contact with the first pin head 229A, electrical current is free to flow across the first terminal 223 and through the bulkhead 230 via the first pin 220A. Likewise, with respect to the second communication switch 225, when the bias force of the second spring 226 is overcome, the second terminal 227 can be brought into contact with the fourth pin head 229D to create an electrical pathway (e.g., for power and/or communication) across the second comms lead 228 through the second terminal 227 and through the bulkhead 230 via the fourth pin 220D.

The power switch 240 can be disposed on the first surface 231. In one or more embodiments, the power switch 240 can be axially aligned with the slot 235. The power switch 240 can include a power switch terminal 241, a power switch spring 243, and a conductive track 242. In one or more embodiments, a first power lead 244 is coupled to the power switch terminal 241, and a second power lead 245 is coupled to the conductive track 242. The first power lead 244 can be coupled to a power source (e.g., a battery) and the second power lead 245 can be coupled to circuity of the tool, e.g., to a printed circuit board (PCB). Alternatively, the second power lead 245 can be coupled to the power source and the first power lead 244 can be coupled to circuity of the tool. In one or more embodiments, the power switch 240 defaults to an "OFF" position via a bias force provided by the power switch spring 243. When the bias force of the power switch spring 243 is overcome, the power switch 240 can shift to an "ON" position, i.e., a position having an electrical pathway through the power switch terminal 241 and the conductive track 242. With the power switch terminal 241 and the conductive track 242 in electrical contact, the power source and the circuity of the tool can be brought into electrical contact (via the first power lead 244 and the second power lead 245), i.e., power is supplied to the circuitry.

Keeping the power switch 240 in a default "OFF" position can preserve battery life and/or avoid unnecessary operation of the tool, e.g., when the tool is not being serviced, used, or calibrated, or when electrical communications are being performed with one or more devices located on the tool side of the bulkhead connector and prior to deployment of the tool body including the bulkhead connector into a wellbore in order to preserve the electrical energy present in devices, such as a battery, which is also located on the tool side of the bulkhead connector. The power switch spring 243 may be any biasing member that applies a biasing force against power switch terminal 241 to bias it away from the conductive track 242. For example, the power switch spring 243 may be a coil spring, a bow spring, a tensile spring, a leaf spring, or the like. In one or more embodiments, the power switch spring 243 may be replaced with two magnets with opposite polarity that repel each other, e.g., with a first magnet disposed on the power switch terminal 241 and a second magnet disposed on the conductive track 242 such that the first and second magnets repel each other.

FIG. 2B depicts a second cross-sectional view of the first example bulkhead portion along the line 2B-2B, according to one or more embodiments. FIG. 2B depicts a cross-sectional view of the bulkhead portion 200 along the line 2B-2B. The bulkhead 230 can have a cylindrical cross-sectional shape, as depicted. However, other cross-sectional shapes are possible, e.g., square, triangular, hexagonal, octagonal, etc. The slot 235 can also have a cylindrical cross-sectional shape, as depicted, but similarly, other cross-sectional shapes are possible, e.g., square, triangular, hexagonal, octagonal, etc. In FIG. 2B, six pins are depicted: the first pin 220A, a second pin 220B, a third pin 220C, the fourth pin 220D, a fifth pin 220E, and a sixth pin 220F. While six pins are shown, less or more pins could be utilized. For example, two pins, three pins, fours pins, seven pins, or eight pins could be used. As will be discussed infra, the pins can be used for communication across the bulkhead 230. For example, one or more pins can act as a transmit path and one or more other pins can act as a receive path. In one or more embodiments, at least one pin can act as a ground path. In one or more embodiments, at least one pin can act as a path for power to be applied to the tool, e.g., to a PCB.

Figure 3B:
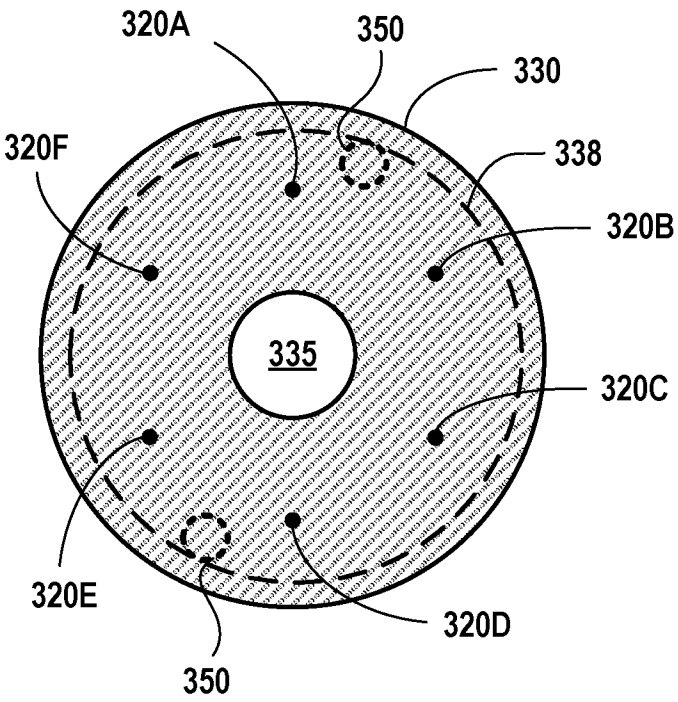
FIG. 3B depicts a second cross-sectional view of the second example bulkhead portion along the line 3B-3B, according to one or more embodiments.
Figure 3A:
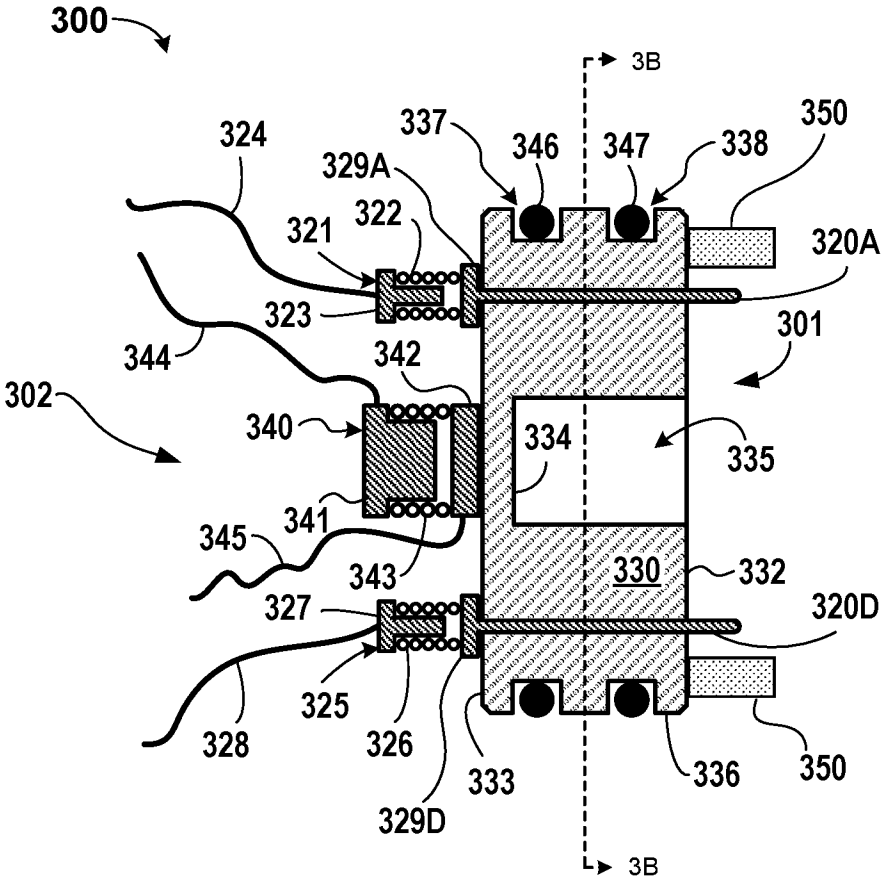
FIG. 3A depicts a first cross-sectional view of a second example bulkhead portion of a magnetically isolating feedthrough connector, according to one or more embodiments.

FIG. 3A depicts a first cross-sectional view of a second example bulkhead portion 300 of a magnetically isolating feedthrough connector, according to one or more embodiments. In various embodiments, the magnetically isolating feedthrough connector illustrated in FIG. 3A may be connector 111 as illustrated and described above with respect to FIG. 1.

Referring back to FIG. 3A, the second example bulkhead portion 300 includes a bulkhead 330, two or more pins (two pins, a first pin 320A and a fourth pin 320D are shown), two or more communication switches (the first communication switch 321 and the second communication switch 325 are shown), and a power switch 340. Bulkhead 330 has two sides, a first side 301 and a second side 302, each facing opposite directions, i.e., a first direction and a second direction, respectively. First side 301 of the bulkhead 330 is configured to be exposed to higher levels of fluid pressures, such as fluid pressures present within the wellbore when a completion or intervention tool that includes bulkhead 330 is deployed and/or is operating within a wellbore. Second side 302 of bulkhead 330 is configured to be adjacent to area(s), such as compartment 113 as illustrated and described with respect to FIG. 1, which are hydraulically sealed from and protected from being exposed to the fluid pressure(s) present in areas adjacent to first side 301 by one or more sealing devices, as further described below.

Referring again to FIG. 3A, instead of a neck and a first and third surface, the bulkhead 330 has a single surface 333, i.e., in essence the first surface and the third surface form a single surface. The single surface 333 faces the first direction and is opposite a second surface 332 facing in the second direction. In one or more embodiments, the bulkhead 330 can have the shape of a cylinder or disk with the single surface 333 and the second surface 332 being joined by a sidewall 336.

The power switch 340 can be disposed on the single surface 333. For example, the power switch 340 can be centered on the single surface 333. A slot 335 can be formed in the bulkhead 330. The slot 335 can extend from the second surface 332 to a fourth surface 334. The fourth surface 334 can face in the second direction or substantially in the second direction. The slot 335 (and/or the fourth surface 334) can be centered or substantially centered with the power switch 340. In one or more embodiments, the single surface 333 and the fourth surface 334 can be opposite one another. Similar to the bulkhead 230, the sidewall 336 of the bulkhead 330 can include one or more recesses (two are shown: a first recess 337 and a second recess 338). Each recess can provide space for a seal, for example one or more O-rings and/or metal seals, to provide sealing for the bulkhead 330. As shown, the first O-ring 346 is disposed in the first recess 337 and the second O-ring 347 is disposed in the second recess 338. Although two recesses and two O-rings are shown, there could be only one recess in the sidewall 336 with one O-ring, or there could be more than two recess in the sidewall 336 with more than two O-rings. Although not shown, instead of O-rings, a metal-to-metal seal could be used, i.e., without any O-rings.

The two or more pins can be disposed through the bulkhead 330 and can protrude from the second surface 332. For example, the two or more pins can extend from the single surface 333 through the bulkhead 330 and protrude from the second surface 332. In one or more embodiments, the two or more pins can extend parallel with the slot 335. As depicted, the first pin 320A and the fourth pin 320D extend from the single surface 333 and protrude through the second surface 332. The two or more pins can each have a pin head that is disposed on the single surface 333. For example, as shown, the first pin head 329A and the fourth pin head 329D are disposed on the single surface 333. In one or more embodiments, the two or more pins are molded into the bulkhead 330. The two or more communication switches can be coupled to the two more pins just as described above with respect to the bulkhead 230 in FIG. 2A. Pins 320A and 320D may be configured to be coupled to one or more devices, such as comms connector 790 (FIG. 7A), in order to provide electrical connections through the bulkhead 330. In various embodiments, one or more orientation pins 350 may extend away from second surface 332. Orientation pin(s) 350 may be configured to engage one or more corresponding notches (such as notches 750, FIG. 7A) in order to allow proper orientation, and thus the correct electrical connections, to be made to pins 320A, 320A and any additional pins included in bulkhead 330 with the external devices that may be brought into physical contact and electrical connection with the pins such as pins 320A and 320D. In various embodiments, orientation pins 350 are configured so that the ends of orientation pins extend a distance that is farther from second surface 332 than a distance that the ends of pins 320A and 320D extend away from second surface 332 in order to assure the proper orientation, and thus the proper electrical connections, are being made to pins 320A, 320D, and any other pins extending through bulkhead 330 before any actual electrical connections via contact with the electrically conductive pins can be made. The number, shape, and relative orientation of the orientation pins 350 as shown in FIG. 3A is non-limiting and provided as an illustrative example, where different numbers, different shapes, and different relative arrangements of orientation pins and corresponding orientation notches could be utilized to perform the orientation function between the electrically conductive pins extend from the fluid side of the bulkhead and devices brought into physical and electrical coupling the electrically conductive pins.

For example, referring to FIG. 3A, a first communication switch 321 is coupled to the first pin 320A, e.g., to the first pin head 329A, and a second communication switch 325 is coupled to the fourth pin 320D, e.g., to the fourth pin head 329D. In one or more embodiments, each of the two or more communication switches may comprise a terminal, a spring, and a comms lead. For example, the first communication switch 321 has a first terminal 323, a first spring 322, and a first comms lead 324 coupled to the first terminal 323, and the second communication switch 325 has a second terminal 327, a second spring 326, and a second comms lead 328 coupled to the second terminal 327.

In one or more embodiments, the two or more communication switches may default to an "OFF" or "open" position via a bias force provided by the respective springs. When the bias force of the springs is overcome, the two or more communication switches can shift to an "ON" or "closed" position, i.e., a position having an electrical pathway through the comms lead, the terminal, and a pin, e.g., via the pin head. For example, with respect to the first communication switch 321, when the bias force of the first spring 322 is overcome, the first terminal 323 can be brought into contact with the first pin head 329A, thereby creating an electrical pathway (e.g., for power and/or communication) between the first comms lead 324 and the first pin 320A. When the first terminal 323 is in contact with the first pin head 329A, electrical current is free to flow across the first terminal 323 and through the bulkhead 330 via the first pin 320A. Likewise, with respect to the second communication switch 325, when the bias force of the second spring 326 is overcome, the second terminal 327 can be brought into contact with the fourth pin head 329D to create an electrical pathway (e.g., for power and/or communication) across the second comms lead 328 through the second terminal 327 and through the bulkhead 330 via the fourth pin 320D.

Still referring to FIG. 3A, the power switch 340 can be disposed on the single surface 333. In one or more embodiments, the power switch 340 can be axially aligned with the slot 335. The power switch 340 can include a power switch terminal 341, a power switch spring 343, and a conductive track 342. In one or more embodiments, a first power lead 344 is coupled to the power switch terminal 341, and a second power lead 345 is coupled to the conductive track 342. The first power lead 344 can be coupled to a power source (e.g., a battery) and the second power lead 345 can be coupled to circuity of the tool, e.g., to a printed circuit board (PCB). Alternatively, the second power lead 345 can be coupled to the power source and the first power lead 344 can be coupled to circuity of the tool. In one or more embodiments, the power switch 340 defaults to an "OFF" position via a bias force provided by the power switch spring 343. When the bias force of the power switch spring 343 is overcome, the power switch 340 can shift to an "ON" position, i.e., a position having an electrical pathway through the power switch terminal 341 and the conductive track 342. With the power switch terminal 341 and the conductive track 342 in electrical contact, the power source and the circuity of the tool can be brought into electrical contact (via the first power lead 344 and the second power lead 345), i.e., power is supplied to the circuitry.

Keeping the power switch 340 in a default "OFF" position can preserve battery life and/or avoid unnecessary operation of the tool, e.g., when the tool is not being serviced, used, or calibrated. or when electrical communications are being performed with one or more devices located on the tool side of the bulkhead connector and prior to deployment of the tool body including the bulkhead connector into a wellbore in order to preserve the electrical energy present in devices, such as a battery, which is also located on the tool side of the bulkhead connector. The power switch spring 343 may be any biasing member that applies a biasing force against power switch terminal 341 to bias it away from the conductive track 342. For example, the power switch spring 343 may be a coil spring, a bow spring, a tensile spring, a leaf spring, or the like. In one or more embodiments, the power switch spring 343 may be replaced with two magnets with opposite polarity that repel each other, e.g., with a first magnet disposed on the power switch terminal 341 and a second magnet disposed on the conductive track 342 such that the first and second magnets repel each other.

FIG. 3B depicts a second cross-sectional view of the second example bulkhead portion along the line 3B-3B, according to one or more embodiments. FIG. 3B depicts a cross-sectional view of the second example bulkhead portion 300 along the line 3B-3B. The bulkhead 330 can have a cylindrical cross-sectional shape, as depicted. However, other cross-sectional shapes are possible, e.g., square, triangular, hexagonal, octagonal, etc. The slot 335 can also have a cylindrical cross-sectional shape, as depicted, but similarly, other cross-sectional shapes are possible, e.g., square, triangular, hexagonal, octagonal, etc. In FIG. 3B, six pins are depicted: the first pin 320A, a second pin 320B, a third pin 320C, the fourth pin 320D, a fifth pin 320E, and a sixth pin 320F. While six pins are shown, less or more pins could be utilized. For example, two pins, three pins, fours pins, seven pins, or eight pins could be used. As will be discussed infra, the pins can be used for communication between the second bulkhead 330. For example, one or more of the pins 320A, 320B, 320C, 320D, 320E, and 320F can be a transmit path and one or more other pins can be a receive path. In one or more embodiments, at least one pin can be a ground path. In one or more embodiments, at least one pin can be a path for power to be applied to the tool, e.g., to a PCB.

Bulkheads of a magnetically isolating feedthrough connector can be a non-conductive and non-magnetic material. For example, the bulkhead 230 and/or the bulkhead 330 can be made of a thermoplastic that retains mechanical and chemical resistance properties at high temperatures, e.g., polyether ether ketone (PEEK), Polyether ketone (PEK), polytetrafluoroethylene (PTFE), ARLON® 3000 XT, polyetherimide (PEI), or the like. High temperatures refer to temperatures above 150° C., above 175° C., or above 200° C. In one or more embodiments, the bulkhead 230 and/or the bulkhead 330 can have a metal frame integrated therein, e.g., to support the thermoplastic, yet still maintaining electrical isolation of the pins disposed therethrough. In one or more embodiments, the bulkhead 230 and/or the bulkhead 330 can be composed mostly (i.e., more than 50%) of metal and can have thermoplastic surrounding and/or sheathing the two or more pins to preserve electrical isolation between the pins and/or the power switch. In one or more embodiments, metal can be added as a frame to the thermoplastic to increase its structural integrity while maintaining electrical isolation of the two or more pins.

Figure 4:
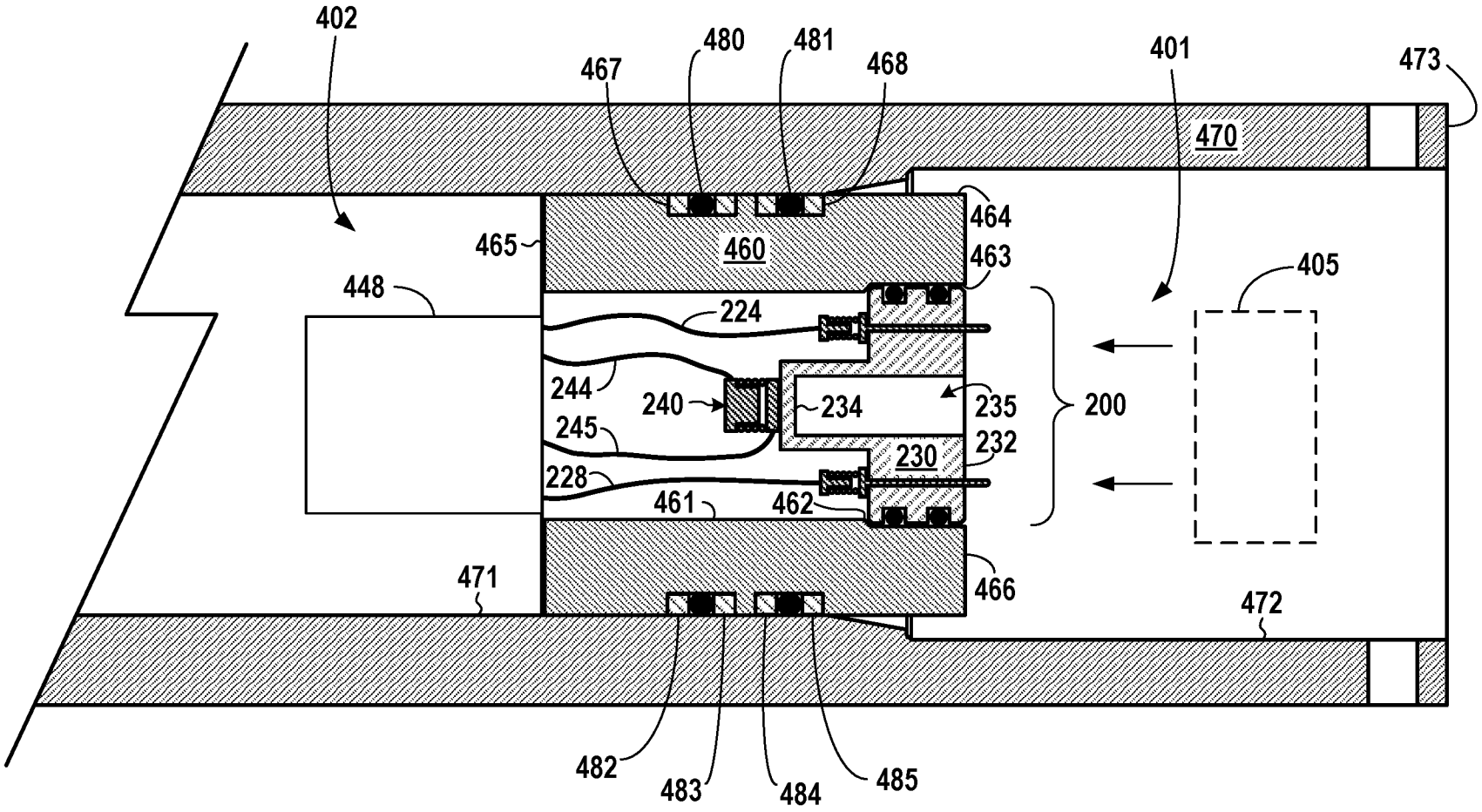
FIG. 4 depicts a cross-sectional view of the first example bulkhead portion disposed within a tool body, according to one or more embodiments.

FIG. 4 depicts a cross-sectional view of the first example bulkhead portion 200 disposed within a tool body 470, according to one or more embodiments. In one or more embodiments, the first example bulkhead portion 200 can be disposed in a spacer 460, where the spacer 460 is disposed in the tool body 470. Alternatively, the spacer 460 may not be present and the bulkhead portion 200 may be positioned directly within the tool body 470. In such embodiments, an outer diameter of the bulkhead portion 200 (i.e. an outer diameter of the bulkhead 230) can be approximately equal to an inner diameter of the tool body 470.

As depicted in FIG. 4, the spacer 460 includes an interior spacer sidewall 461, a spacer shoulder 462, a recessed spacer sidewall 463, and an exterior spacer sidewall 464. The exterior spacer sidewall 464 can be disposed against, i.e., abutting, a first interior tool body sidewall 471 of the tool body 470. The tool body 470 can also include a second interior sidewall 472 and a tool body end 473. In one or more embodiments, the spacer 460 can have an annular shape, e.g., shaped as a ring, a short tubular, or the like. The spacer 460 can have two ends in its axial direction, a first spacer end 465 facing in the first direction and a second spacer end 466 facing in the second direction. The first spacer end 465 can be disposed against one or more tool components 448 (or at least a housing thereof). The one or more tool components 448 can include one or more battery and/or one or more circuit, e.g., on a PCB.

The exterior spacer sidewall 464 can include one or more spacer recesses (two are shown: a first spacer recess 467 and a second spacer recess 468). Each recess can provide space for one or more O-rings and/or one or more seal ring, e.g., to provide sealing for the spacer 460. As shown, a first spacer O-ring 480 is disposed in the first spacer recess 467 between a first seal ring 482 and a second seal ring 483, and a second spacer O-ring 481 is disposed in the second spacer recess 468 between a third seal ring 484 and a fourth seal ring 485. The spacer O-rings 480 and 481 can act to act back-up and/or additional support sealing mechanisms in high pressure and temperature applications. Although two recesses and two O-rings are shown, there could be only one recess in the exterior spacer sidewall 464 with one O-ring and one or more seal ring, or there could be more than two recess in the exterior spacer sidewall 464 with more than two O-rings and more than four seal rings. In some embodiments, spacer O-rings may not be present. Although not shown, instead of O-rings, a metal-to-metal seal could be used, i.e., without any O-rings. In one or more embodiments, O-rings are disposed in the one or more spacer recess, but no seal rings are disposed therein. In one or more embodiments where the spacer 460 is not present, O-rings of the bulkhead 230 (e.g. the O-rings 246 and 247 of FIG. 2A) can provide a seal between the bulkhead 230 and the tool body 470.

In various embodiments, bulkhead 230 in combination with spacer 460 forms a pressure seal between space 401 within tool body 470 on the first side of the bulkhead and space 402 within the tool body 470 on a second side of the bulkhead opposite the first side. A side of the bulkhead connector that is exposed to space 401 may be referred to as the "fluid side" and/or "the high pressure side" because that portion of the bulkhead connector may be exposed to fluids present in the wellbore, and the associated fluid pressure present within the wellbore, when the tool body including the bulkhead connector is deployed downhole into the wellbore. A side of the bulkhead connector that is exposed to space 402 may be referred to as the "tool side" and/or as the "low pressure side" because that portion of the bulkhead connector, and one or more downhole tools on that fluid side of the bulkhead connector, are isolated and protected from the wellbore fluids and the associated wellbore fluid pressure by the seal and the bulkhead connector itself. In various embodiments, fluid pressures that may be present on the fluid side of the bulkhead connector may range from atmospheric pressure, or about 15 pounds/per square inch (PSI) up to 15,000 PSI when operating in a wellbore environment. Fluid pressures that may be present on the tool side of the bulkhead connector may be much lower, normally in a range of atmospheric pressure (15 PSI). The bulkhead connector itself, including the seals that may be included with the bulkhead connector, and the spacer and any seals associated with the spacer, are configured to withstand the range of pressure differentials that may be expected to occur between the tool side and the fluid side of the bulkhead connector, including providing the fluid seal at temperatures that may be experiences when operating in a wellbore environment.

In one or more embodiments, the bulkhead 230 can be sealingly coupled to the spacer 460. For example, although not depicted, the sidewall 236 of the bulkhead portion 200 can be threaded to fit in corresponding threads in the recessed spacer sidewall 463 of the spacer 460 and the O-rings and threads can pressure seal the connection. Similarly, in one or more embodiments, the spacer 460 can be sealingly coupled to the tool body 470. For example, the exterior spacer sidewall 464 is threaded to fit corresponding threads in the first interior tool body sidewall 471 and the threads and O-rings and/or seal rings can pressure seal the connection. In embodiments where spacer 460 is not provided, bulkhead 230 may be sealingly coupled to the interior tool body sidewall(s) in order to form a pressure seal between space 401 and space 402. In various embodiments, space 401 is configured to withstand higher fluid pressures, such as fluid pressure present within the wellbore where the tool body 470 is deployed, wherein the pressure seals provided by the bulkhead (and in conjunction with the spacer when the spacer is provided), isolates and protects space 402, and therefore also tools 448, from exposure to the fluid pressures that might be present in space 401.

In various embodiments once positioned as shown in FIG. 4, the seal(s) between space 401 and 402 may be tested to confirm they will provide the required level of pressure seal between these spaces when one or more test pressure levels within space 401 are present. Once the proper operation of the seal(s) have been confirmed and prior to the deployment of the tool body 470 into a wellbore, one or more devices 405, (such as a comms connector and/or other smart devices), may be coupled to the electrical connectors provided by the bulkhead 200, and various operations, such as testing, data downloads, and other electrical operation may be performed on the tools 448 through the bulkhead and without the need to disturb the seals. These features provide advantages, including being able to test, program, and operate one or more of the tools 448 after the tools have been positioned within the tool body, and without the need to disturb the seals providing the pressure separation between space 401 and 402 prior to deployment of the tools into a wellbore. Upon completion of the communications processes between the devices 405 and the tools 448, the devices 405 may be disconnected from the bulkhead 200, while leaving the seals between space 401 and 402 intact and undisturbed. In various embodiments, the communication operations between devices 405 and tools 448 may be completed without the need to switch the tools into an activated mode that would be utilized once the tools are deployed downhole. For example, programming and/or data could be downloaded to one or more of tools 448 without the need to place the tool(s) into an activated mode of operation.

Figure 5A:
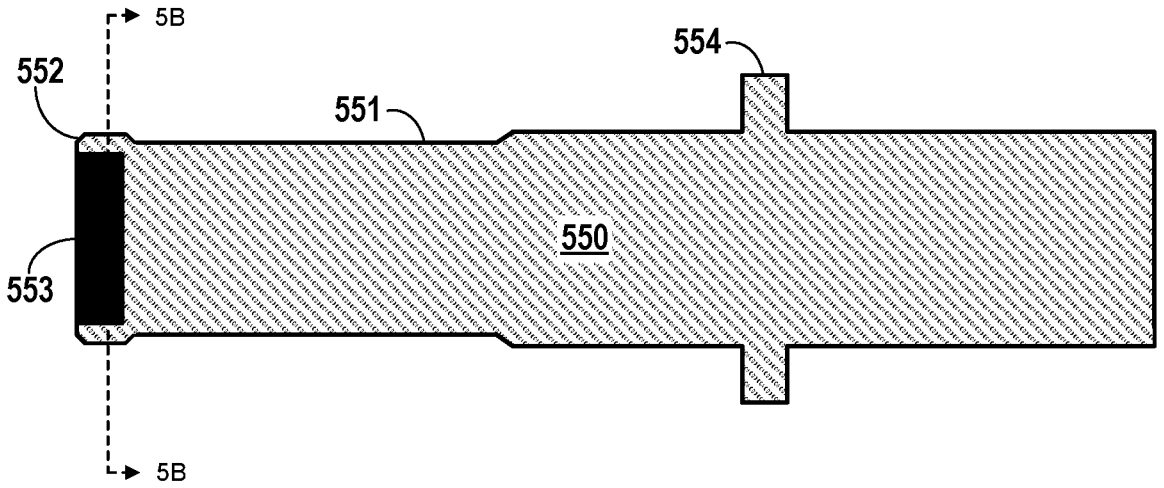
FIG. 5A depicts a first cross-sectional view of an example mating connector of a magnetically isolating feedthrough connector, according to one or more embodiments.

FIG. 5A depicts a first cross-sectional view of an example mating connector 550 of a magnetically isolating feed-through connector, according to one or more embodiments. The mating connector 550 includes a post 551 having a first end 552 and a shoulder 554. A first magnet 553 is disposed on the post 551 proximate the first end 552. In one or more embodiments, the first magnet 553 may be recessed in the post 551 at the first end 552. The first magnet 553 can be fixed to the post 551 via one or more connections, e.g., threads, compression fit, bolts, or the like.

Figure 5B:
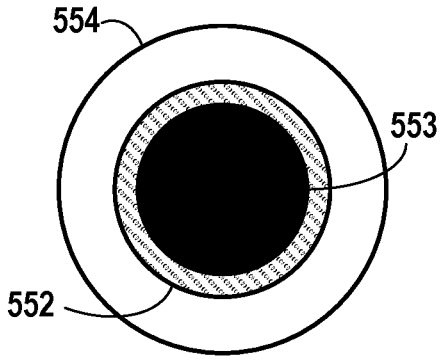
FIG. 5B depicts a second cross-sectional view of the example mating connector along the line 5B-5B, according to one or more embodiments.

FIG. 5B depicts a second cross-sectional view of the example mating connector along the line 5B-5B, according to one or more embodiments. FIG. 5B depicts a second cross-sectional view of the mating connector 550 along the line 5B-5B. The first magnet 553 can be a cylinder or disc, as shown, or can have other shapes, e.g., a rectangular prism or a cube. In one or more embodiments, the post 551 can have a cylindrical cross section. In other embodiments, the post 551 can have another cross-sectional shape, e.g., hexagonal, triangular, octagonal, elliptical, etc. The cross-sectional shape of the post 551 can correspond to the cross-sectional shape of the slot 235. Mating connector 550 may be received into a cavity of a bulkhead connector, for example as illustrated and described below with respect to FIG. 6, in order to turn a power switch included in the bulkhead connector from an "OFF" or open position to an "ON" or closed position.

Figure 6:
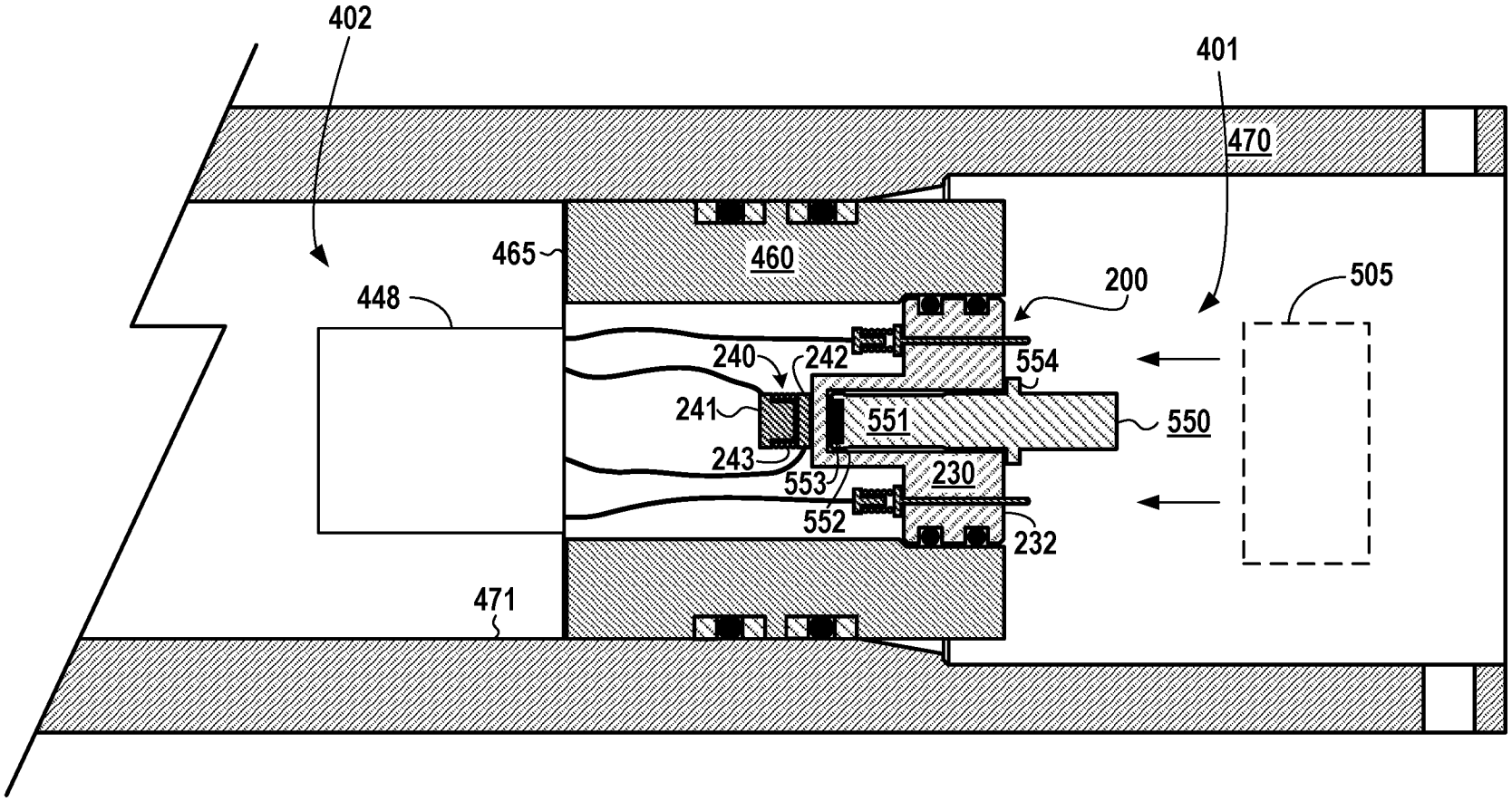
FIG. 6 depicts a cross-sectional view of the example mating connector of FIGS. 5A-5B disposed on the first example bulkhead portion of FIGS. 2A-2B, according to one or more embodiments.

FIG. 6 depicts a cross-sectional view of the example mating connector of FIGS. 5A-5B disposed on the first example bulkhead portion of FIGS. 2A-2B, according to one or more embodiments. FIG. 6 depicts a cross-sectional view of the mating connector 550 disposed in the first example bulkhead portion 200. As depicted, the post 551 of the mating connector 550 is disposed in the slot 235, with the first end 552 disposed against the fourth surface 234 (see FIG. 2A). The post 551 can be sized to fit in the slot 235. In one or more embodiments, both the slot 235 and the post 551 can have a cylindrical cross-sectional shape with the post 551 having a first diameter and the slot 235 having a second diameter, where the first diameter is less than the second diameter.

When the post 551 is disposed fully into the slot 235, the first end 552 of the mating connector 550 can be disposed against, e.g., pushed against, the fourth surface 234, thereby bringing the first magnet 553 proximate to the power switch 240. The first magnet 553 can be sufficiently strong to attract the power switch terminal 241 towards the conductive track 242 to overcome the bias force of the power switch spring 243. In the case where the power switch spring 243 is replaced by first and second magnets of opposite polarity, the force of the first magnet 553 can be strong enough to overcome the repelling force between the first and second magnets of the power switch. With the mating connector 550 in this position and the power switch terminal 241 in electrical contact with the conductive track 242, circuity in the tool components 448 can be connected to one or more batteries to supply power for performing one or more functions of the downhole tool (e.g., the first completion sub 110, the second completion sub 112, or the like). When the mating connector 550 is moved at least partially out of the slot 235, the magnetic force of the first magnet 553 on the power switch 240 weakens and the bias force of the power switch spring 243 (or in the alternative the first and second magnets of the power switch when provided) can force the power switch terminal 241 away from the conductive track 242, thereby severing the electrical connection therebetween, and disconnecting a power supply (i.e. batteries) from the tool circuity.

The post 551 can be prevented from going too far into the slot 235 by the shoulder 554, which can be brought into contact with the second surface 232 of the bulkhead 230 when the post 551 is fully inserted within the bulkhead portion 200. Note, while the bulkhead portion 200 with the bulkhead 230 is shown in FIG. 6, the mating connector 550 can work the same, in principle, with the bulkhead portion 300 and the bulkhead 330 shown in FIGS. 3A-3B. For example, an embodiment of bulkhead 330 may be installed within a spacer, such as spacer 460, which may then be installed within a tool body, such as tool body 470. In one alternative embodiment bulkhead 330 may be installed within a tool body, such as tool body 470, without the use of a spacer. Once installed, a post such as post 551 having a magnet, such as magnet 553, installed at an end of the post may be inserted into slot 335 of bulkhead 330 in order to actuate power switch 340 from an "OFF" position to an "ON" position. When in the "ON" position the power switch terminal 341 is moved toward and into contact with the conductive track 342 in order to provide an electrical connection between the first power lead 344 and the second power lead 345 through power switch 340. When post 551 is withdrawn at least partially or completely from slot 335 of bulkhead 330, the power switch spring 343 or other biasing member provided as part of power switch 340 is configured to move the power switch terminal 341 away from conductive track 342, thus placing the power switch 340 in the "OFF" position and breaking the electrical connection between the first power lead 344 and the second power lead 345.

As shown in FIG. 6, the mating connector 550 may be installed in the bulkhead connector in order to activate the one or more tools 448 located in space 402 while the seals providing the pressure seal between space 401 and 402 remain intact and undisturbed. With the mating connector 550 fully received in the slot of the bulkhead connector, a device 505 comprising a comms connector may be coupled to one or more of the pins extending through the bulkhead connector, the device 505 configured in some embodiments to provide a visual indication that one or more of the tools 448 have been properly activated prior to deployment of the tool body 470 into a wellbore. In some embodiments, device 505 may include a smart device, such as a laptop computer, which may be used to electronically communicate with the tools 448 to confirm whether the tools have been properly activated by the insertion of the mating connector into the bulkhead connector before deployment of the tool body 470 into a wellbore. In various embodiments, devices 505 are disconnected from the bulkhead connector prior to deployment of the tool body 470 into a wellbore.

Figure 7B:
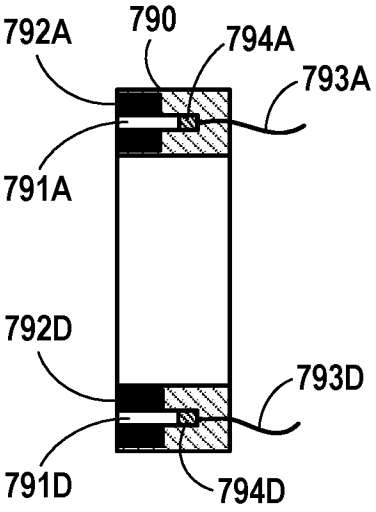
FIG. 7B depicts a cross sectional view of the example comms connector, according to one or more embodiments.
Figure 7A:
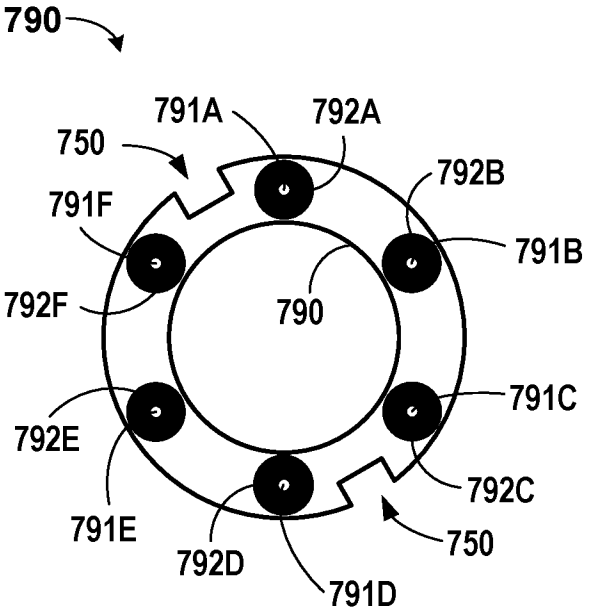
FIG. 7A depicts a top view of an example comms connector of a magnetically isolating feedthrough connector, according to one or more embodiments.

FIG. 7A depicts a top view of an example comms connector 790 of a magnetically isolating feedthrough connector, according to one or more embodiments. In various embodiments, comms connector 790 is an example of a device 505 that may be electrically coupled to a bulkhead connector, such as bulkhead connector 200, as illustrated in FIG. 6. In various embodiments, comms connector 790 may includes one or more orientation notches 750. Orientation notch(s) 750 may be arranged on the body of comms connector 790 having a shape and a spatial arrangement that corresponds with one or more orientation pins (orientation pins 250, FIG. 2A; orientation pins 350, FIG. 3A). The orientation notch(s) are configured to provide a proper orientation, and thus the described electrical connections to occur when comms connector 790 is brought into physical contact and electrical coupling with the electrically conductive pins of a bulkhead connector, such as bulkhead connector 230 (FIG. 2A) or bulkhead connector 330 (FIG. 3A).

Referring again to FIG. 7A, comms connector 790 includes two or more receptors (six are shown: a first receptor 791A, a second receptor 791B, a third receptor 791C, a fourth receptor 791D, a fifth receptor 791E, and a sixth receptor 791F) and two or more comms magnets (six are shown: a first comms magnet 792A, a second comms magnet 792B, a third comms magnet 792C, a fourth comms magnet 792D, a fifth comms magnet 792E, and a sixth comms magnet 792F). The number of receptors and number of comms magnets can correspond to a number of pins in the bulkhead (e.g., in the bulkhead 230 of the bulkhead portion 200 or the bulkhead 330 of the bulkhead portion 300). The number of receptors can match the number of comms magnets.

The receptors may be a recess or slot to receive a pin from a bulkhead portion of a magnetically isolating feedthrough connector. Each receptor can be sized and/or shaped to receive one of the two or more pins. In one or more embodiments, each of the receptors has the same cross-sectional shape as the pin to be disposed therein. For example, the receptors can have a circular cross-sectional shape to receive pins having a circular cross-sectional shape.

In one or more embodiments, the pins protruding from the second surface of the bulkhead (e.g., second surface 232 or second surface 332) have a third diameter and the receptors each have fourth diameter, where the third diameter is less than the fourth diameter, i.e., so the pins slip or fit into the receptors.

The comms magnets can have hole therethrough to allow the pin to pass through the comms magnets into the respective receptor. The hole in each of the comms magnets can have the same cross-sectional shape as the pin and/or the receptor. In one or more embodiments, the hole can be substantially circular and may have a diameter equal to or larger than the fourth diameter. In one or more embodiments, the comms connector 790 can be shaped to fit around the mating connector 550 and can provide support and location for pins to slide through the hole in the comms magnets into the receptors. For example, the comms connector 790 can be shaped as a ring, as depicted, having the receptors and comms magnets equally spaced around a center of the ring.

FIG. 7B depicts a cross sectional view of the example comms connector, according to one or more embodiments. FIG. 7B depicts a cross sectional view of the comms connector 790. The comms connector 790 can further include two or more comms connector contacts (two are shown: a first comms connector contact 794A and a fourth comms connector contact 794D) and two more comms connector leads (two are shown: a first comms connector lead 793A and a fourth comms connector lead 793D). Each of the two or more comms connector contacts is disposed at an end of a respective receptor of the two or more receptors. For example, as shown, the first comms connector contact 794A is disposed at an end of the first receptor 791A and the fourth comms connector contact 794D is disposed at an end of the fourth receptor 791D. Each of the two or more comms connector leads is coupled to a respective one of the two or more comms connector contacts. For example, as shown, the first comms connector contact 794A is coupled to the first comms connector lead 793A, and the fourth comms connector contact 794D is coupled to the fourth comms connector lead 793D.

In one or more embodiments, the comms connector leads 793A and 793D can be coupled to instrumentation (e.g., at the surface) to communicate with the downhole tool. For example, the comms connector leads can be connected to a wireless transceiver module (not shown), e.g., using BLUETOOTH® or another wireless transmission standard and/or technology. The wireless transceiver module can allow communication from instrumentation remote from the downhole tool via the comms connector 790. For example, the wireless transceiver module can allow communication from the comms connector 790 to instrumentation for testing or controlling the downhole tool disposed remotely, e.g., not in the line of sight of the tool, without running external wires to the comms connector 790.

Figure 8:
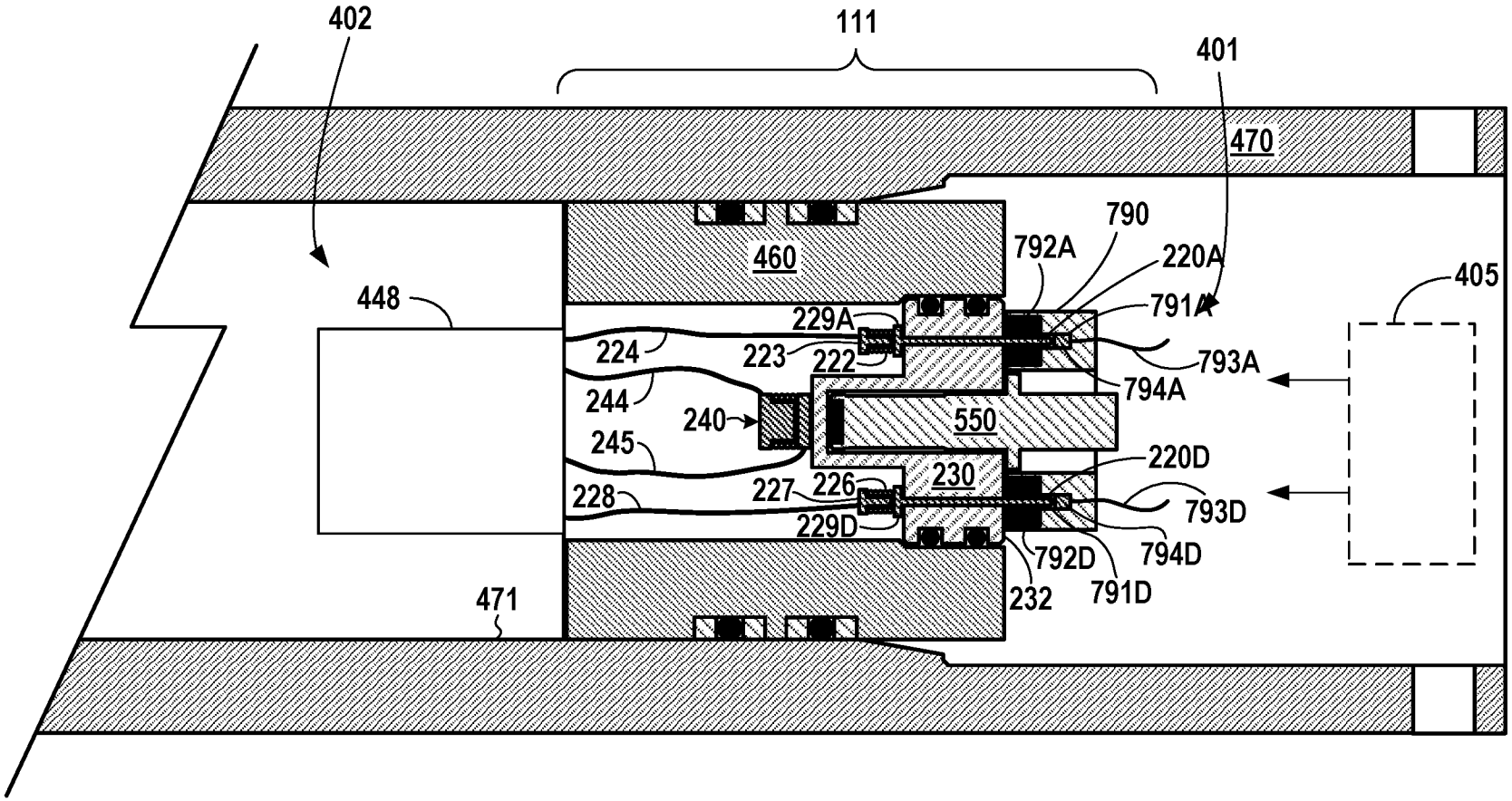
FIG. 8 depicts a cross-sectional view of the comms connector of FIGS. 7A-7B disposed on the first example bulkhead portion of FIGS. 2A-2B, according to one or more embodiments.

FIG. 8 depicts a cross-sectional view of the example comms connector 790 of FIGS. 7A-7B disposed on the first bulkhead portion 230 of FIGS. 2A-2B, according to one or more embodiments. As shown, the comms connector 790 is disposed on the bulkhead 230 such that each of the two or more pins is disposed through a respective comms magnet, into a respective receptor, thereby electrically coupling the respective pin with a respective comms connector contact, i.e., each of the two or more pins is electrically coupled to one of the comms connector contacts. For example, the first pin 220A is disposed through the first comms magnet 792A, into the first receptor 791A so that the end of the first pin 220A is in contact, i.e., sufficient to provide electrical coupling, with the first comms connector contact 794A. Similarly, the fourth pin 220D is disposed through the fourth comms magnet 792D, into the fourth receptor 791D so that the end of the fourth pin 220D is in contact, i.e., sufficient to provide electrical coupling, with the fourth comms connector contact 794D.

Disposing the comms connector 790 onto the bulkhead 230 can bring the comms magnets close to the communication switches. As depicted, the first comms magnet 792A is proximate the first pin head 229A and the first terminal 223 of the first communication switch 221. The first comms magnet 792A creates a magnetic force on the first terminal 223 overcoming the bias force of the first spring 222 to close the first communication switch 221, i.e., moving it to an "ON" position, thereby creating a communication path from the first comms lead 224, through the first communication switch 221, through the first pin 220A, through the first comms connector contact 794A, to the first comms connector lead 793A. Similarly, the fourth comms magnet 792D is proximate the fourth pin head 229D and the second terminal 227 of the second communication switch 225. The fourth comms magnet 792D creates a magnetic force on the second terminal 227 overcoming the bias force of the second spring 226 to close the second communication switch 225, i.e., moving it to an "ON" position, thereby creating a communication path from the second comms lead 228, through the second communication switch 225, through the fourth pin 220D, through the fourth comms connector contact 794D, to the fourth comms connector lead 793D.

As noted above, the comms connector 790 can be shaped, e.g., in the ring shape shown in FIG. 7A, such that the comms connector 790 can be disposed around the mating connector 550, i.e., so the mating connector 550 can slide in or out of the slot 235 with the comms connector 790 in place. This allows powering on or powering off via the power switch 240 with the comms connector 790 in place. For example, the comms connector 790 can be disposed on the bulkhead 230 and then the mating connector 550 can be inserted (or fully inserted if previously partially inserted) to power on the downhole tool via the power switch 240. As shown, the mating connector is disposed in the slot 235 and the power switch 240 is engaged in an "ON" position.

In some embodiments, the comms connector 790 may not have a center channel through which the mating connector 550 can be inserted. This can prevent excess power being supplied by the power switch 240 from damaging batteries/electronics of the tool when external power is applied. When the comms connector 790 is in place and the mating connector 550 is not inserted, external power can be provided via the comms leads 224 and 228 to communicate with the tool. When the comms connector 790 is disposed on a bulkhead of a magnetically isolating feedthrough connector that is positioned within a downhole tool, the comms connector 790 can allow for communication with the downhole tool from the surface when the downhole tool is positioned within a wellbore. In some embodiments, the downhole tool can have a mode of operation that is to be initiated once the downhole tool is positioned within the wellbore. Once a downhole mode of the tool has been initiated, the comms connector 790 can be used to confirm the downhole mode has been activated. Further, the comms connector 790 can be used to transmit data being acquired by the tool once the tool is activated.

In some embodiments, a magnetically isolating feedthrough connector can include a combination of a bulkhead, a mating connector, and a comms connector. With reference to FIG. 1, the magnetically isolating feedthrough connector 111 can be formed by the combination of the bulkhead 230, the mating connector 550, and the comms connector 790. In one or more embodiments, a magnetically isolating feedthrough connector may not include a comms connector. For example, the magnetically isolating feedthrough connector 111 can include the bulkhead 230 and the mating connector 550. The magnetically isolating feedthrough connector 111 can assure the tool components 448 are pressure sealed, i.e., not subject to well pressure, yet still can be powered on and communicate therewith. For example, the side 402 of the tool components 448 and the leads can be at a lower pressure than the side 401 of the second surface 232 of the bulkhead 230. In addition, because the communication only occurs when the comms connector 790 is attached and power only is turned on when the mating connector 550 is inserted, a risk of shorting the tool due to fluids or weather seeping into the end of the tool body 470 can be reduced. In a manner the same as or similar to the description provided for FIG. 6, one or more devices 405, such as a smart device (e.g., a laptop computer) may be coupled to and used to communicate with the tool(s) 448 through the pins of comms connector 790 and the communication switches provided on the tools side of the bulkhead connector prior to removal of the comms connector and deployment of the tool body 470 into a wellbore.

Figure 9B:
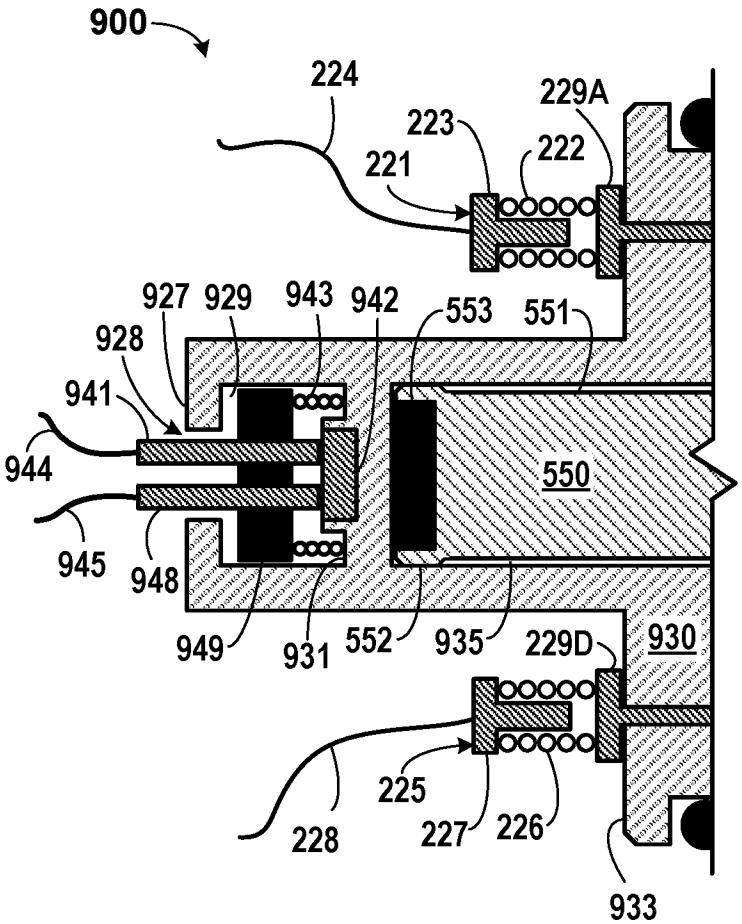
FIG. 9B depicts a second cross-sectional view of the third example bulkhead portion with a mating connector inserted, according to one or more embodiments.
Figure 9A:
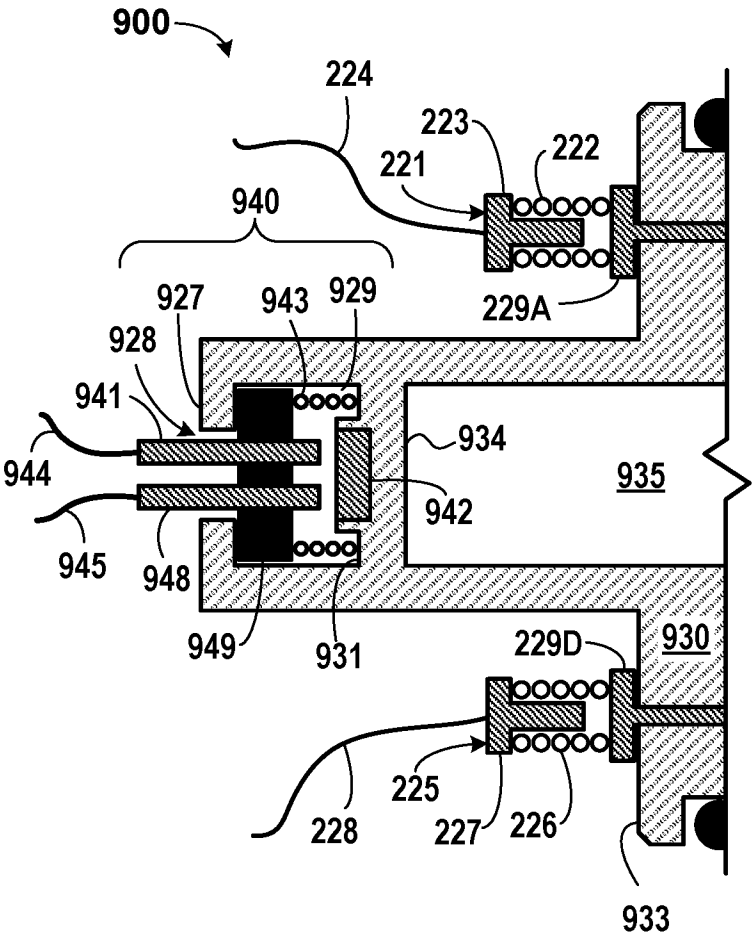
FIG. 9A depicts a first cross-sectional view of a third example bulkhead portion of a magnetically isolating feedthrough connector having a second power switch integrated with a bulkhead, according to one or more embodiments.

FIG. 9A depicts a first cross-sectional view of a third example bulkhead portion of an example magnetically isolating feedthrough connector having a second power switch integrated with the third bulkhead, according to one or more embodiments. FIG. 9A depicts a cross-sectional view of a third example bulkhead portion 900 having a power switch 940 integrated with a bulkhead 930. As depicted, the power switch 940 can be formed as part of the bulkhead 930. The bulkhead 930 can include a switch cavity 929, and the components of the power switch 940 can be contained at least partially therein. The power switch 940 can also include a power switch terminal 941, a power switch terminal 948, a power switch magnet 949, a power switch spring 943, and a conductive track 942.

FIG. 9A depicts the conductive track 942 disposed proximate a first cavity surface 931. The first cavity surface 931 can face in the same direction as a third surface 933, both surfaces facing in the first direction. A fourth surface 934 of the bulkhead 930 can form a bottom or end of a slot 935 (the slot 935 being the same or similar to the slot 235 and slot 335). The fourth surface 934 can face the second direction, and the conductive track 942 can be disposed opposite the fourth surface 934.

The power switch magnet 949 may be disposed in the switch cavity 929 and biased towards a cavity lip 927 by the power switch spring 943. Note, the power switch spring 943 could be any biasing member that applies a biasing force against power switch magnet 949 to bias it away from the conductive track 942. For example, the power switch spring 943 can be a coil spring, a tensile spring, a bow spring, a leaf spring, or the like. In one or more embodiments, the power switch spring 943 can be replaced with one or more magnets with opposite polarity that repel each other. For example, the power switch spring 943 can be replaced with a magnet disposed on the conductive track 942 that has opposite polarity from the power switch magnet 949, and thus repels it, but with a repelling force less than the first magnet 553 of the mating connector 550.

The cavity lip 927 is on an opposite side of the switch cavity 929 from the conductive track 942. The cavity lip 927 has a cavity opening 928 disposed therethrough. The power switch terminal 941 and the power switch terminal 948 may each at least partially extend through the cavity opening 928 to attach to power switch leads 944 and 945, respectively. The power switch terminal 941 can connect to the power switch lead 944 and the power switch terminal 948 can connect to the power switch lead 945. In an alternative embodiment, instead of a single cavity opening 928, two cavity openings could be used, i.e., one for each power switch terminal 941 and 948. Both the power switch terminal 941 and the power switch terminal 948 can be coupled to the power switch magnet 949. In some embodiments, the power switch terminals 941 and 948 may be directly coupled to the power switch leads 944 and 945, respectively. Alternatively, the power switch terminals 941 and 948 may be indirectly coupled to the power switch leads 944 and 945, respectively. For example, the power switch terminals 941 and 948 may be indirectly coupled with the power switch leads 944 and 945, respectively, by a frame connected to the power switch magnet 949. Both the power switch terminal 941 and the power switch terminal 948 may extend past the power switch magnet 949 in a direction of the conductive track 942. In one or more embodiments, the power switch terminal 941 and the power switch terminal 948 may be electrically isolated from one another while biased away from the conductive track 942.

The bulkhead 930 can be at least partially composed of a thermoplastic that retains mechanical and chemical resistance properties at high temperatures, e.g., polyether ether ketone (PEEK), Polyether ketone (PEK), polytetrafluoroethylene (PTFE), ARLON® 3000 XT, polyetherimide (PEI), or the like. In one or more embodiments, the bulkhead 930 can have a metal frame integrated therein, e.g., to support the thermoplastic, yet still maintaining electrical isolation of two or more pins disposed therethrough. In one or more embodiments, the bulkhead 930 can be composed mostly (i.e., more than 50%) of metal and can have thermoplastic surrounding and/or sheathing the two or more pins to preserve electrical isolation between the two or more pins and/or the power switch 940. In one or more embodiments, metal can be added as a frame to the thermoplastic to increase its structural integrity while maintaining electrical isolation of two or more pins.

FIG. 9B depicts a second cross-sectional view of the third example bulkhead portion with a mating connector inserted, according to one or more embodiments. FIG. 9B depicts a cross-sectional view of the third example bulkhead portion 900 with the mating connector 550 inserted. As depicted, the mating connector 550 is disposed in the slot 935 such that the first magnet 553 is proximate and/or touching the fourth surface 934. The first magnet 553 and the power switch magnet 949 can be polarized such that there is an attractive force therebetween strong enough to overcome the bias force of the power switch spring 943 in order to bring the power switch terminal 941 and the power switch terminal 948 into contact with the conductive track 942, thereby electrically coupling the power switch terminal 941 and the power switch terminal 948. This can allow electrical connection through the power switch 940 between two components, e.g., between a battery and circuity, which are coupled to a respective one of the power switch lead 944 and the power switch lead 945.

Figure 10A:
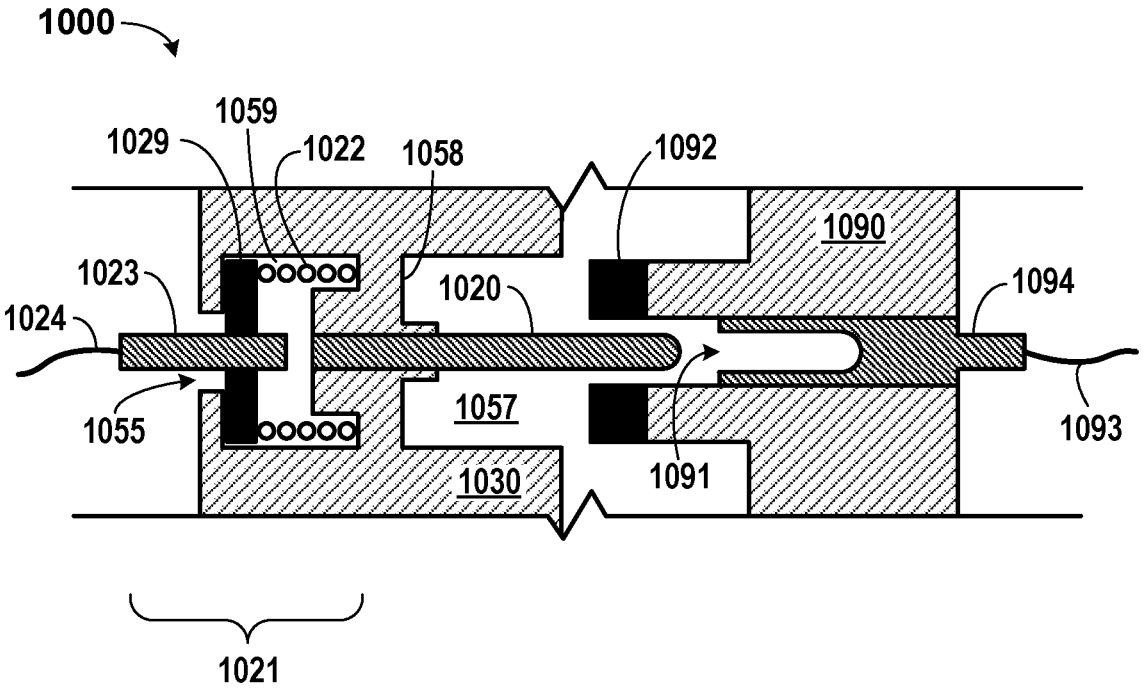
FIG. 10A depicts a first cross-sectional view of an example communication switch in an "open" position, according to one or more embodiments.

FIG. 10A depicts a first cross-sectional view of an example communication switch in an "open" position, according to one or more embodiments. FIG. 10A depicts a cross-sectional view 1000 of an example communication switch 1021 that may be integrated within a bulkhead 1030 of a magnetically isolated feedthrough connector. The communication switch 1021 may be integrated into a bulkhead of a bulkhead portion of the magnetically isolated feedthrough connector. As shown, the communication switch 1021 and a pin 1020 are formed as part of the bulkhead 1030. Only a portion of the bulkhead 1030 is shown for the sake of simplicity, but it will be understood that a power switch, either integrated or attached to the bulkhead 1030, can be included as described in any of the previous embodiments. The bulkhead 1030 may include a comms switch cavity 1059, and components of the communication switch 1021 can be at least partially contained at least partially therein. The communication switch 1021 includes a comms terminal 1023, one or more comms switch magnet 1029 (one is shown), and a comms spring 1022. A comms lead 1024 may be coupled to the comms terminal 1023 to provide a communication path for communication with electrical components of a downhole tool, e.g., tool components 448.

The pin 1020 may extend from a comms slot 1057 formed in the bulkhead 1030 opposite the communication switch 1021 and/or the comms switch cavity 1059. The pin 1020 is shown without a pin head, but a pin head could be included to extend a contact surface of the pin 1020. The comms switch magnet 1029 can be disposed in the comms switch cavity 1059, and may be biased towards the "open" position by the comms spring 1022. The comms spring 1022 may be any biasing member that applies a biasing force against comms switch magnet 1029 to bias it away from the pin 1020. For example, the comms spring 1022 can be a coil spring, a tensile spring, a bow spring, a leaf spring, or the like. In one or more embodiments, the comms spring 1022 can be replaced with one or more magnets with opposite polarity that repel each other, e.g., replaced with a magnet that has opposite polarity from the comms switch magnet 1029 and thus repels it, but with a repelling force less than a comms magnet 1092 of a comms connector 1090.

The comms terminal 1023 can at least partially extend through a comms cavity opening 1055 to connect to the comms lead 1024. The comms terminal 1023 may be directly or indirectly coupled to the comms switch magnet 1029. The communication switch 1021 can include a comms connector 1090 having a comms connector contact 1094 disposed within a pin receptor 1091 that is to receive the pin 1020 when the communication switch 1021 is turned on. The comms connector contact 1094 can have slot or shape to receive the pin 1020 therein sufficient to establish an electrical connection between the pin 1020 and the comms connector contact 1094 when the communication switch is in the "open" position.

The comms connector contact 1094 can be coupled to a comms lead 1093 to provide communication across the communication switch 1021 through an electrical path created by the comms terminal 1023, the pin 1020, and the comms connector contact 1094 when the communication switch 1021 is in the "closed" position. The comms lead 1093 can be coupled to instrumentation (e.g., at the surface) to communicate with the downhole tool. For example, the comms lead 1093 can be connected to a wireless transceiver module (not shown), e.g., using BLUETOOTH® or another wireless transmission standard and/or technology. The wireless transceiver module can allow communication from instrumentation remote from the downhole tool via the comms connector 1090. For example, the wireless transceiver module can allow communication from the comms connector 1090 to instrumentation for testing or controlling the downhole tool disposed remotely, e.g., not in the line of sight of the tool, without running external wires to the comms connector 1090. In one or more embodiments, the wireless transceiver module is battery operated.

The communication switch 1021 can be moved from the "open" position to the "closed" position through movement of the comms connector 1090. FIG. 10A depicts the communication switch in the "open" position, where the pin 1020 and the comms connector contact 1094 are not in contact. As the comms connector 1090 is moved toward the bulkhead 1030, the comms magnet 1092 of the comms connector 1090 can attract the comms switch magnet 1029 to bring the comms terminal 1023 into contact with the pin 1020.

Figure 10B:
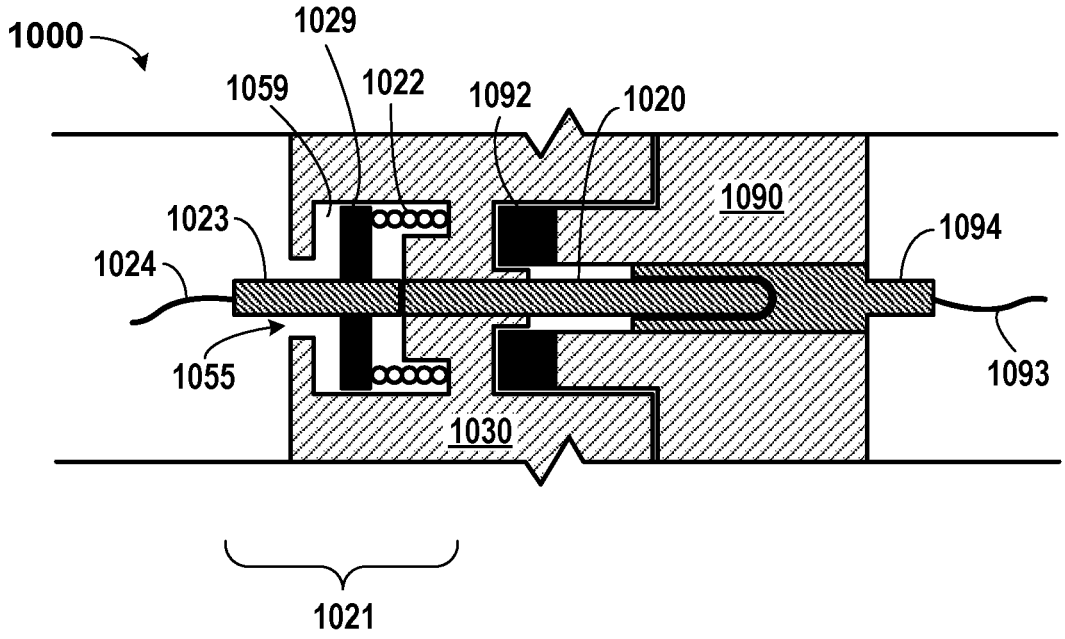
FIG. 10B depicts a second cross-sectional view of the example communication switch in a "closed" position, according to one or more embodiments.

FIG. 10B depicts a second cross-sectional view of the example communication switch in a "closed" position, according to one or more embodiments. FIG. 10B depicts a cross-sectional view of the example communication switch 1021 having the comms connector 1090 engaged with the bulkhead 1030. With the comms terminal 1023 in contact with the pin 1020 and the pin 1020 in contact with the comms connector contact 1094, an electrical path is created between the comms lead 1093 and the comms lead 1024, e.g., to be used for transmitting or receiving a signal.

Note, while only one integrated comms switch is shown, two or more comms integrated comms switches can be formed in the bulkhead 1030 and operate similarly to the comms switches disclosed previously to create communication paths through the bulkhead 1030 when the switches are in an "ON" state. Also, while a comms slot is shown, the bulkhead 1030 could instead have a flat surface from which the pin 1020 protrudes (e.g., like second surface 232) and the comms switch magnet 1029 could instead abut to the flat surface around the protruding pin 1020. Having the comms slot 1057 can minimize stress on the pin 1020, e.g., to avoid breaking or bending the pin 1020.

Figure 11B:
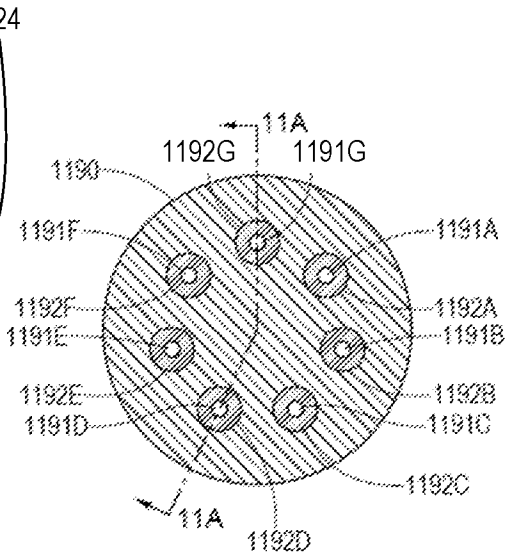
FIG. 11B depicts a cross-sectional view of the comms connector of the example magnetically isolating feedthrough connector along the line 11B-11B, according to one or more embodiments.
Figure 11A:
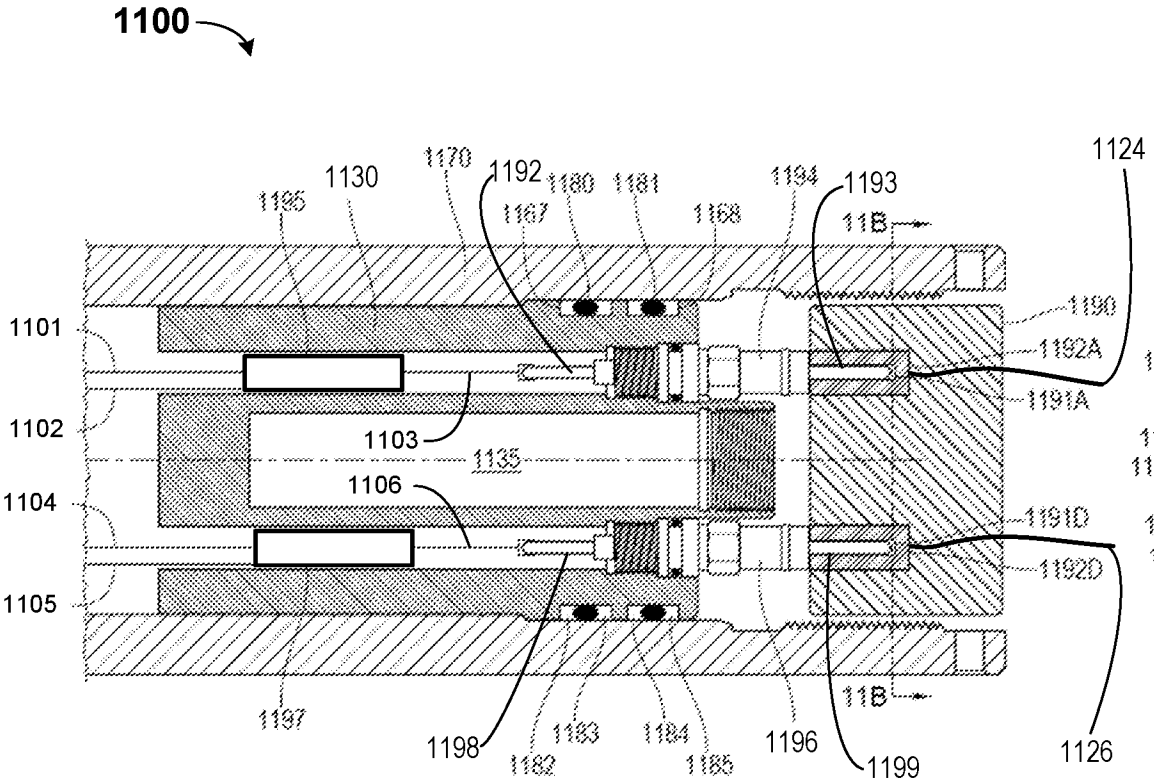
FIG. 11A depicts a cross-sectional view of an example magnetically isolating feedthrough connector, according to one or more embodiments.

FIG. 11A depicts a cross-sectional view of an example magnetically isolating feedthrough connector 1100, according to one or more embodiments. The magnetically isolating feedthrough connector (connector) 1100 includes a bulkhead connector 1130 positioned within a tool body 1170. In various embodiments, bulkhead connector 1130 may include one or more O-rings 1180 and 1181 and spacer rings 1182, 1183, 1184, and 1185, each O-ring disposed within one of recesses 1167 and 1168 of the bulkhead 1130 to establish a hydraulic seal across the connector 1100. Establishing the hydraulic seals is not limited to the use of O-rings, or to the use of only O-rings. In various embodiments a metal-to-metal seal may be used to form the hydraulic seal. In various movements, both O-ring and metal-to-metal seals may be used in combination to form the hydraulic seal. In various embodiments, one or more electrical contacts 1194 and 1196 can be positioned at least partially within the bulkhead 1030. Each electrical contact 1194 and 1196 can also include pins extending therefrom. FIG. 11A depicts the electrical contact 1194 as having a first pin 1192 extending into the bulkhead 1130 and a second pin 1193 extending away from the bulkhead 1130 in a direction opposite the first pin 1192. Similarly, the electrical contact 1196 includes a first pin 1198 extending into the bulkhead 1130 and a second pin 1199 extending away from the bulkhead 1130 in the opposite direction.

In contrast to the example bulkhead portions of FIGS. 2A, 3A, and 9A, which employ magnets to establish electrical continuity across a connector, FIG. 11A depicts the bulkhead 1130 having switches 1195 and 1197 within the bulkhead 1130. Switches 1195 and 1197 are not limited to a particular type of switch, and in some embodiments may be Hall effect or reed switches. Switches 1195 and 1197 may be electrically coupled to the electrical contacts 1194 and 1196, respectively. FIG. 11A depicts the switch 1195 electrically connected to the first pin 1192 of the electrical contact 1194 via conductor 1103, and the switch 1197 electrically connected to the first pin 1198 of the electrical contact 1196 via conductor 1106.

The opposite pins 1193 and 1199 of the electrical contacts 1194 and 1195, respectively, can extend at least partially into recesses 1191A and 1191D of a comms connector 1190 to allow for communication across the connector 1100. The comms connector 1190 can be similar in both structure and function to the comms connector 790 of FIG. 7A. However, in contrast to the comms connector 790, the particular version of comms connector 1190 as illustrated in FIG. 11A does not have a center passage through which a mating connector can be inserted into a cavity 1135 of the bulkhead 1130.

To help illustrate, FIG. 11B depicts a cross-sectional view of the comms connector of the example magnetically isolating feedthrough connector along the line 11B-11B, according to one or more embodiments. The comms connector 1190 can include one or more recesses 1191A, 1191B, 1191C, 1191D, 1191E, 1191F, and 1191G, to receive the pins 1193 and 1199 of the electrical contacts 1194 and 1196, respectively, when the comms connector 1190 is positioned. The number of recesses of the comms connector 1190 can be equal to or greater than the number of pins extending from electrical connectors of the bulkhead 1130.

The comms connector 1190 can be made of an electrically insulating material (e.g. PEEK) and have an electrical contact disposed within each recess. FIG. 11B depicts each of the recesses 1191A, 1191B, 1191C, 1191D, 1191E, 1191F, and 1191G as having an electrical contact 1192A, 1192B, 1192C, 1192D, 1192E, 1192F, and 1192G disposed therein, respectively. The electrical contacts 1192A, 1192B, 1192C, 1192D, 1192E, 1192F, and 1192G can be made of an electrically conductive material and have comms connector leads extending therefrom. FIG. 11A depicts a first comms connector lead 1124 extending from the electrical contact 1192A and a second comms connector lead 1126 extending from the electrical contact 1192D. The comms connector leads 1124 and 1126 can be coupled with instrumentation to communicate with the downhole tool, as previously described in reference to FIG. 7B.

For example, when comms connector 1190 is in place as illustrated in FIG. 11A, first comms connector lead 1124 is coupled to be in electrical contact with one of leads 1101 or 1102 through electrical contact 1192A, contact 1194, first pin 1192, electrical conductor 1103, and switch 1195. Similarly, when comms connector 1190 is in place as illustrated in FIG. 11A, second comms connector lead 1126 is coupled to be in electrical contact with one of leads 1104 or 1105 through electrical contact 1192D, contact 1196, first pin 1198, electrical conductor 1106, and switch 1197. One or more of leads 1101, 1102, 1104, and/or 1105 may be electrically coupled to one or more tools or other electrical circuitry located on the low pressure side of bulkhead 1130 within tool body 1170. In this position, external power can be supplied to the tool to confirm that the tool has successfully initiated a downhole operation mode and/or to test data acquisition functions, as previously described in reference to FIG. 7B. To acquire data using the tool, the comms connector 1190 can be removed to insert a mating connector into the cavity 1135 of the bulkhead 1130 that switches the switches 1195 and 1197 to a second position where power can be supplied to components of the downhole tool via power leads one or some combination of leads 1101, 1102, 1103, and 1104. In various embodiments, when comms connector 1190 is in place as illustrated in FIG. 11A, leads 1101 and 1102 may be electrically coupled together, with or without being electrically coupled to conductor 1103, and leads 1104 and 1105 may be electrically coupled together, with or without being electrically coupled to conductor 1106, depending on the particular application. In various embodiments, comms connector 1190 includes one or more Light Emitting Diodes (LEDs) or other types of visual indicator(s) (not illustrated in FIG. 11A) that provide an indication of the state and/or other information related to the tools, for example a current mode of the tools, when in the configuration as illustrated in FIG. 11A. Although not specifically illustrated in FIGS. 11A and 11B for clarity purposes, the magnetically isolating feedthrough connector 1100 and the comms connector 1190 may include a corresponding set of orientation devices, such as one or more orientation pins and one or more corresponding orientation notches, the set of orientation devices configured to provide a proper orientation between the connector 1100 and the comms connector 1190 as describe above for example with respect to FIGS. 2A, 3A, and 7A.

Figure 12B:
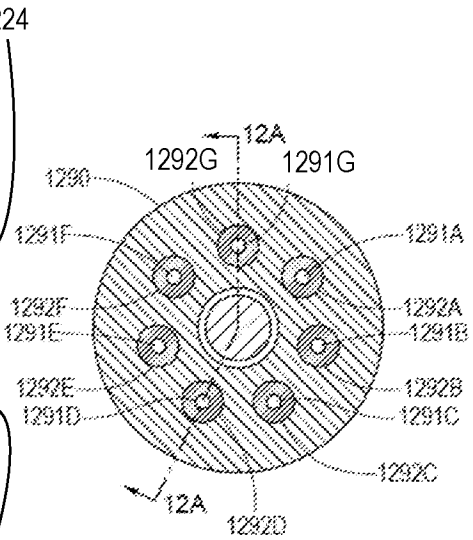
FIG. 12B depicts a cross-sectional view of the example mating connector along the line 12B-12B, according to one or more embodiments.
Figure 12A:
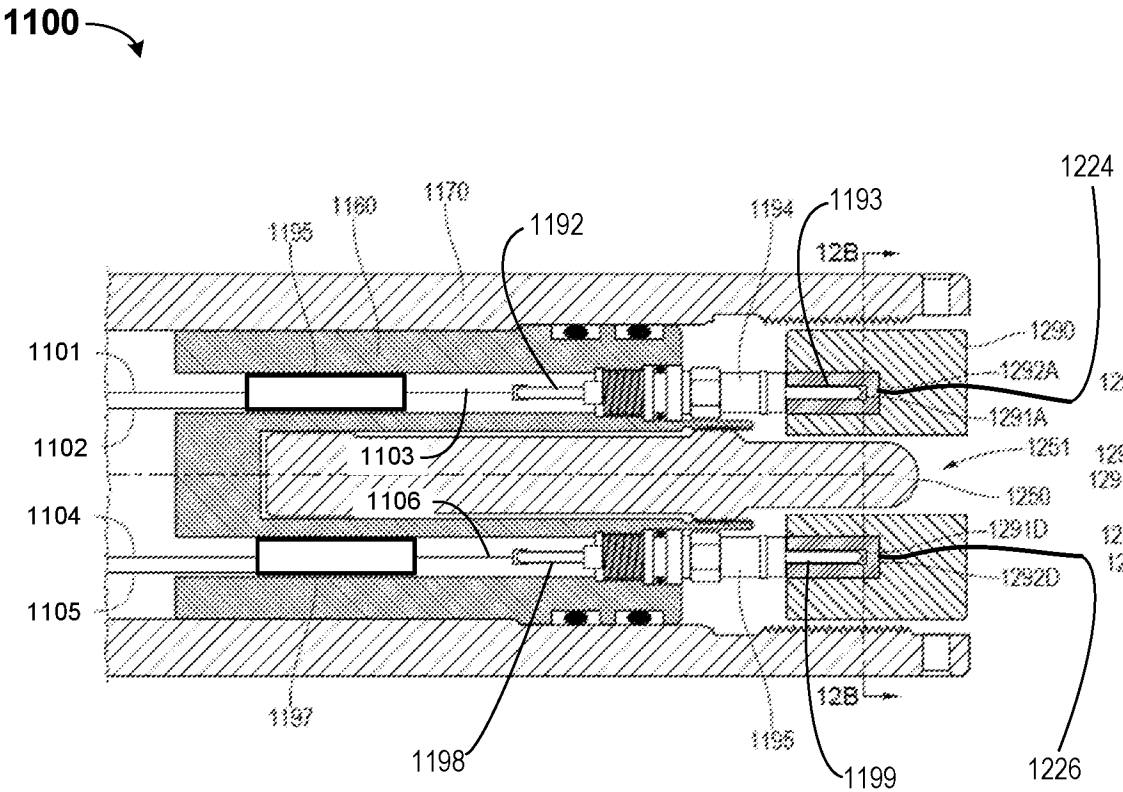
FIG. 12A depicts a cross-sectional view of the example magnetically isolating feedthrough connector having a mating connector disposed therein, according to one or more embodiments.

FIG. 12A depicts a cross-sectional view of the example magnetically isolating feedthrough connector 1160 having a mating connector 1250 disposed within a cavity of the connector 1160, according to one or more embodiments. A comms connector 1290 having a center channel 1251 can be positioned over the mating connector 1250 and the pins 1193 and 1195. As shown, the comms connector 1290 is positioned on the bulkhead 1130 such that pin 1193 and 1199 are disposed into a respective receptor of the comms connector 1290, thereby electrically coupling the respective pin with a respective comms connector contact.

FIG. 12B depicts a cross-sectional view of the example comms connector along the line 12B-12B, according to one or more embodiments. The comms connector 1290 can include one or more receptors 1291A, 1291B, 1291C, 1291D, 1291E, 1291F, and 1291G, to receive the pins 1193 and 1199 of the electrical contacts 1194 and 1196 when the comms connector 1290 is positioned. The number of receptors of the comms connector 1290 can be equal to or greater than the number of pins extending from electrical connectors of the bulkhead 1130.

The comms connector 1290 can be made of an electrically insulating material (e.g. PEEK) and have an electrical contact disposed within each recess. FIG. 12B depicts each of the receptors 1291A, 1291B, 1291C, 1291D, 1291E, 1291F, and 1291G as having a comms connector contact 1292A, 1292B, 1292C, 1292D, 1292E, 1292F, and 1292G disposed therein, respectively. The comms connector contacts 1292A, 1292B, 1292C, 1292D, 1292E, 1292F, and 1292G can be made of an electrically conductive material. When the comms connector 1290 is positioned, the pin 1193 is disposed into a first receptor 1291A so that the end of the pin 1193 is in contact, i.e., sufficient to provide electrical coupling, with a comms connector contact 1292A. Similarly, the pin 1199 is disposed into a receptor 1291D so that the end of the pin 1199 is in contact, i.e., sufficient to provide electrical coupling, with the comms connector contact 1292D. In one or more embodiments, comms connector leads 1224 and 1226 can extend from the comms connector contacts 1292A and 1292D be coupled to instrumentation (e.g., at the surface) to communicate with the downhole tool as described above with respect to FIG. 11A.

Disposing the magnetic holder 1250 within the bulkhead 230 can switch the switches 1195 and 1197 to a second position, relative to the position assumed by switches 1195 and 1197 when the magnetic holder 1250 is not present in the cavity 1135. When the mating connector 1250 is moved at least partially out of the cavity 1135, the magnetic force of the magnetic holder 1250 on the switches 1195 and 1197 weakens, thereby allowing the switches 1195 and 1197 to return to the first position, and in various embodiments thereby disconnecting the electrical power supply (i.e. batteries) from the tool circuity. When the mating connector 1250 is disposed fully into the cavity 1135, the mating connector 1250 can activate the switches 1195 and 1197, moving them to the second position. With the mating connector 1250 in this position and the switches 1195 and 1197 activated to the second position, circuity in the tool components can be connected to one or more batteries to supply power via one or more leads 1101, 1102, 1104, and/or 1105 for performing one or more functions of the downhole tool (e.g., the first completion sub 110, the second completion sub 112, or the like). In various embodiments, once it has been confirmed that the tool circuitry has been powered and is in the desired mode for operation, the comms connector 1190 may be removed while the mating connector 1250 remains in place, and the tool body including the bulkhead may be lowered downhole for use. Although not specifically illustrated in FIGS. 12A and 12B for clarity purposes, the magnetically isolating feedthrough connector 1100 and the comms connector 1290 may include a corresponding set of orientation devices, such as one or more orientation pins and one or more corresponding orientation notches, the set of orientation devices configured to provide a proper orientation between the connector 1100 and the comms connector 1190 as describe above for example with respect to FIGS. 2A, 3A, and 7A.

Figure 13:
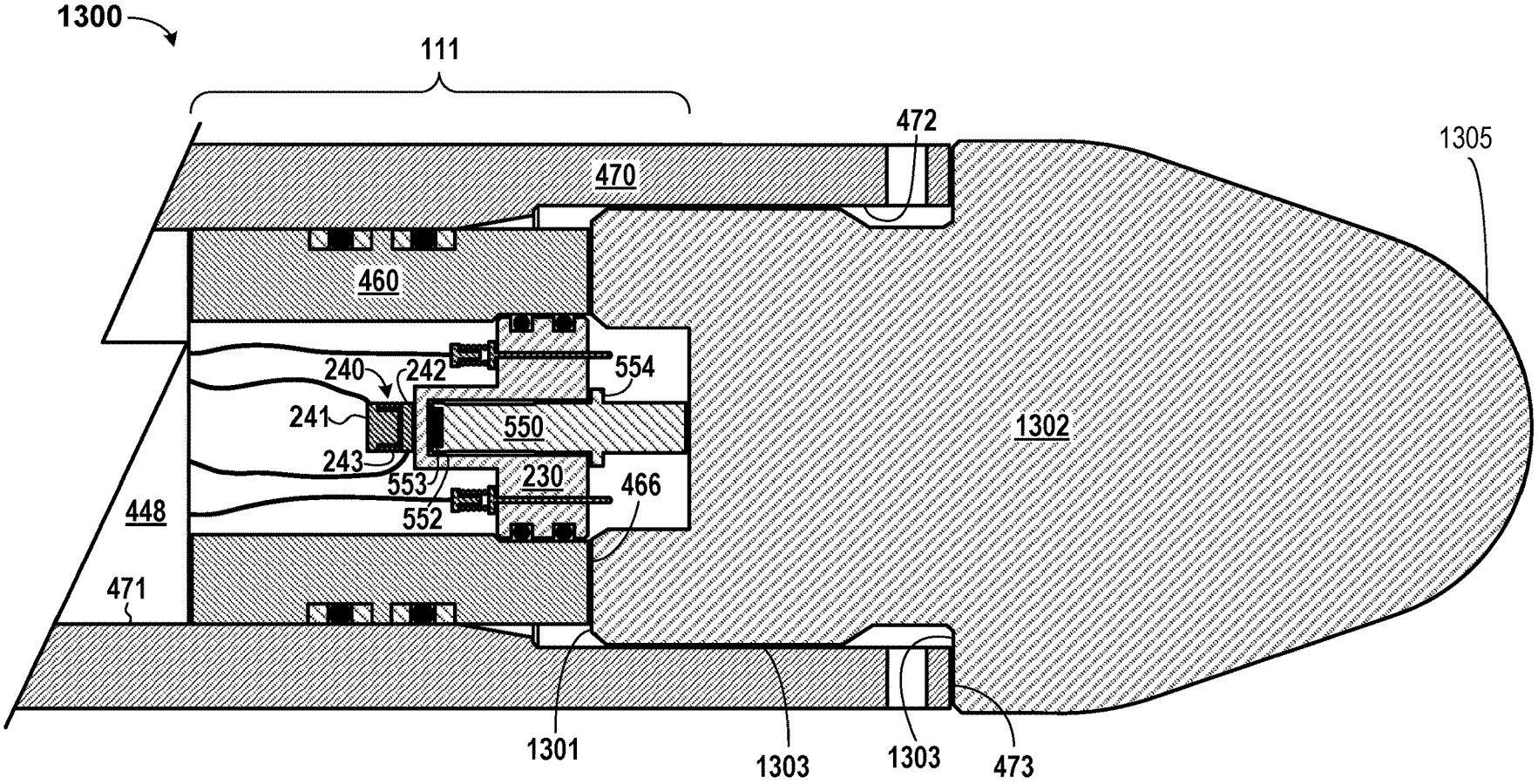
FIG. 13 depicts a bottom sub coupled to a tool body having a first example magnetically isolating feedthrough connector disposed therein, according to one or more embodiments.

FIG. 13 depicts an example configuration 1300 including a bottom sub 1302 coupled to a tool body 470 having a first example magnetically isolating feedthrough connector disposed therein, according to one or more embodiments. In configuration 1300, the tool body 470 includes bulkhead 230 and the mating connector 550 disposed within a cavity of the bulkhead 230. The bulkhead 230 and the mating connector 550 together can form the magnetically isolating feedthrough connector 111. The bottom sub 1302 can protect the magnetically isolating feedthrough connector 111 (e.g., protecting the mating connector 550 and/or the communication pins) and also ensure that that mating connector 550 stays in place. As shown, a first bottom sub edge 1301 can be disposed against the spacer 460 and a second bottom sub edge 1303 can be dispose against the tool body end 473. A leading edge 1305 of the bottom sub may have a curved or rounded shape that enables the tool body 470 to be guided into and through another device, such as a section of casing or an open portion of a wellbore into which the tool body is being inserted into and/or lowered through.

The bottom sub 1302 can be removably fixed to the tool body 470, e.g., attached via threads, screws, removable pins, etc. For example, a sidewall 1303 of the bottom sub 1302 can be threaded to join corresponding threads in the second interior tool body sidewall 472. Access to the magnetically isolating feedthrough connector 111 can be made anytime by removing the bottom sub 1302 and connecting the mating connector 550 and/or one of the comms connector 790 or second comms connector 1090. Removing the bottom sub 1302 does not require disturbing any seals of the bulkhead 230 or the spacer 460, e.g., none of the O-rings are disturbed, allowing communication and/or power with the tool without pressure testing every time the magnetically isolating feedthrough connector 111 is accessed. Further, because the seals provided by the bulkhead (and the seals of the spacer 460 when spacer 460 is provided) perform the function of providing a pressure seal from space within the tool body 470 where the bottom sub 1302 is inserted and the space on the opposite side of the bulkhead where the tools 448 are located, there is no need to provide and/or confirm that the bottom sub 1302 provides a pressure seal relative to the tool body, thus eliminating the extra step and associated cost and time required to perform testing and verification of any pressure sealing between the bottom sub and the tool body.

Although not shown, in one or more embodiments, the comms connector 790 or second comms connector 1090 can be also attached to the bulkhead 230, i.e., to one or more of the pins with the bottom sub 1302 attached. Alternatively, the comms connector 790 or second comms connector 1090 is only attached when the bottom sub 1302 is removed. Note, while the bulkhead 230 is shown, the bottom sub 1302 can be used with the bulkhead 330, the bulkhead 930, the bulkhead 1030, or the bulkhead 1130.

Figure 14:
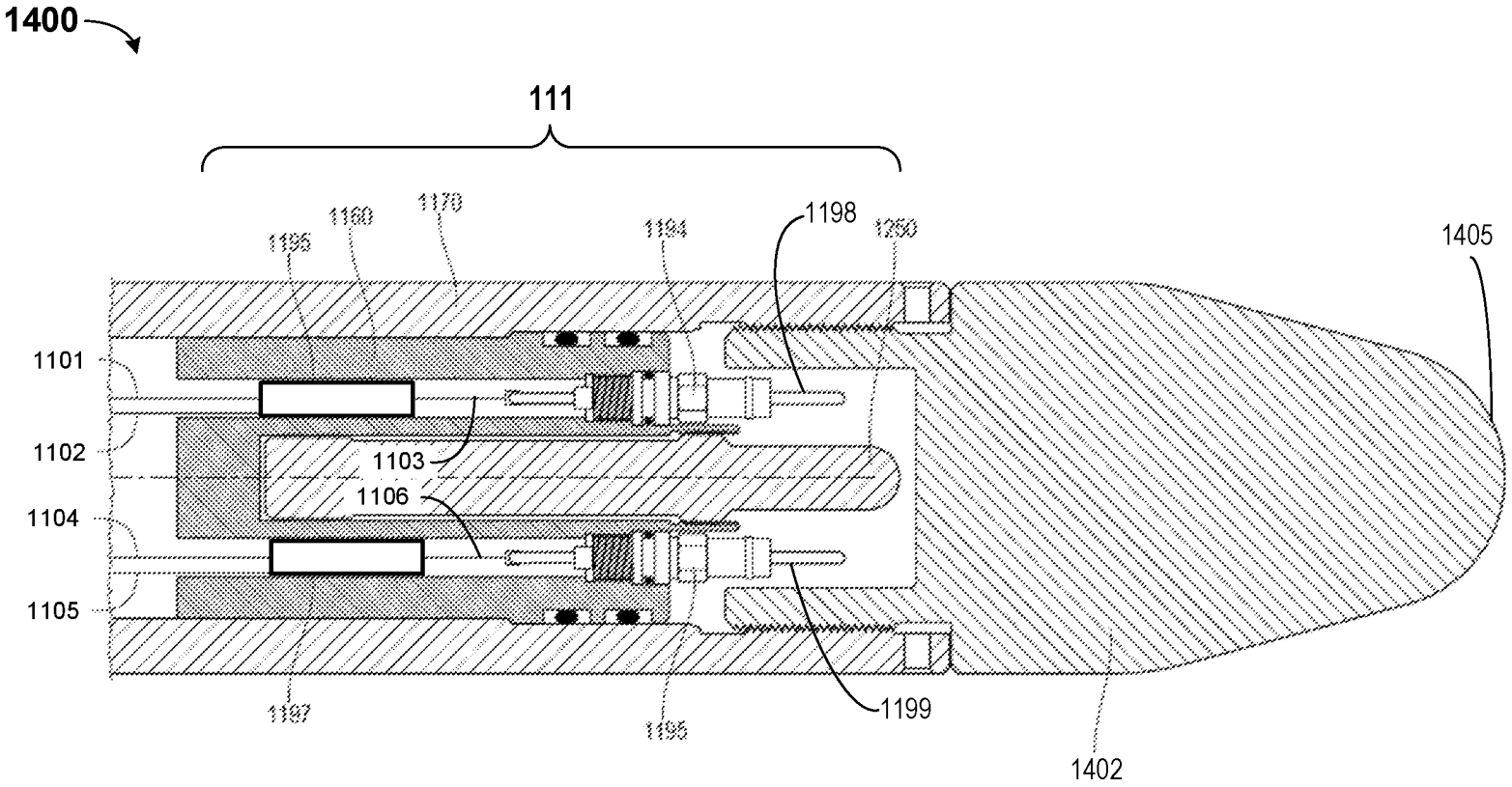
FIG. 14 depicts a bottom sub coupled to a tool body having a second example magnetically isolating feedthrough connector disposed therein, according to one or more embodiments.

FIG. 14 depicts a bottom sub 1402 coupled to a tool body 1170 having a second example magnetically isolating feedthrough connector 111 disposed therein, according to one or more embodiments. In FIG. 14 bottom sub 1402 is coupled to the tool body 1170 having the bulkhead 1160 and the mating connector 1250 disposed with a cavity of the bulkhead. The bulkhead 1160 and the mating connector 1250 can form the magnetically isolating feedthrough connector 111. The bottom sub 1402 can protect the magnetically isolating feedthrough connector 111 (e.g., protecting the mating connector 1250 and/or the pins 1198 and 1199) and also ensure that that mating connector 1250 stays in place.

The bottom sub 1402 can be removably fixed to the tool body 1170, e.g., attached via threads, screws, removable pins, etc. For example, FIG. 14 depicts the bottom sub 1402 fixed to the tool body 1170 by a threaded connection. Access to the magnetically isolating feedthrough connector 111 can be made by removing the bottom sub 1402 and connecting one of the comms connectors, such as comms connector 1190 or comms connector 1290, to the pins, such as pins 1198 and 1199, extending through the bulkhead. Removing the bottom sub 1402 does not require disturbing any seals of the bulkhead 1130, e.g., none of the O-rings are disturbed, allowing communication and/or power with the tool without pressure testing every time the magnetically isolating feedthrough connector 111 is accessed. In various embodiments, the comms connector 1190 or second comms connector 1290 is only attached when the bottom sub 1402 is removed. Further, because the seals provided by the bulkhead 1160 with the tool body 1170 perform the function of providing a pressure seal from space within the tool body 1170 where the bottom sub 1402 is inserted and the space on the opposite side of the bulkhead where the tools located within tool body 1170 are located, there is no need to provide and/or confirm that the bottom sub 1402 provides a pressure seal relative to the tool body, thus eliminating the extra step and associated cost and time required to perform testing and verification of any pressure sealing between the bottom sub and the tool body. A leading edge 1405 of the bottom sub may have a curved or rounded shape that enables the tool body 1170 to be guided into and through another device, such as a section of casing or an open portion of a wellbore into which the tool body is being inserted into and/or lowered through.

Figure 15:
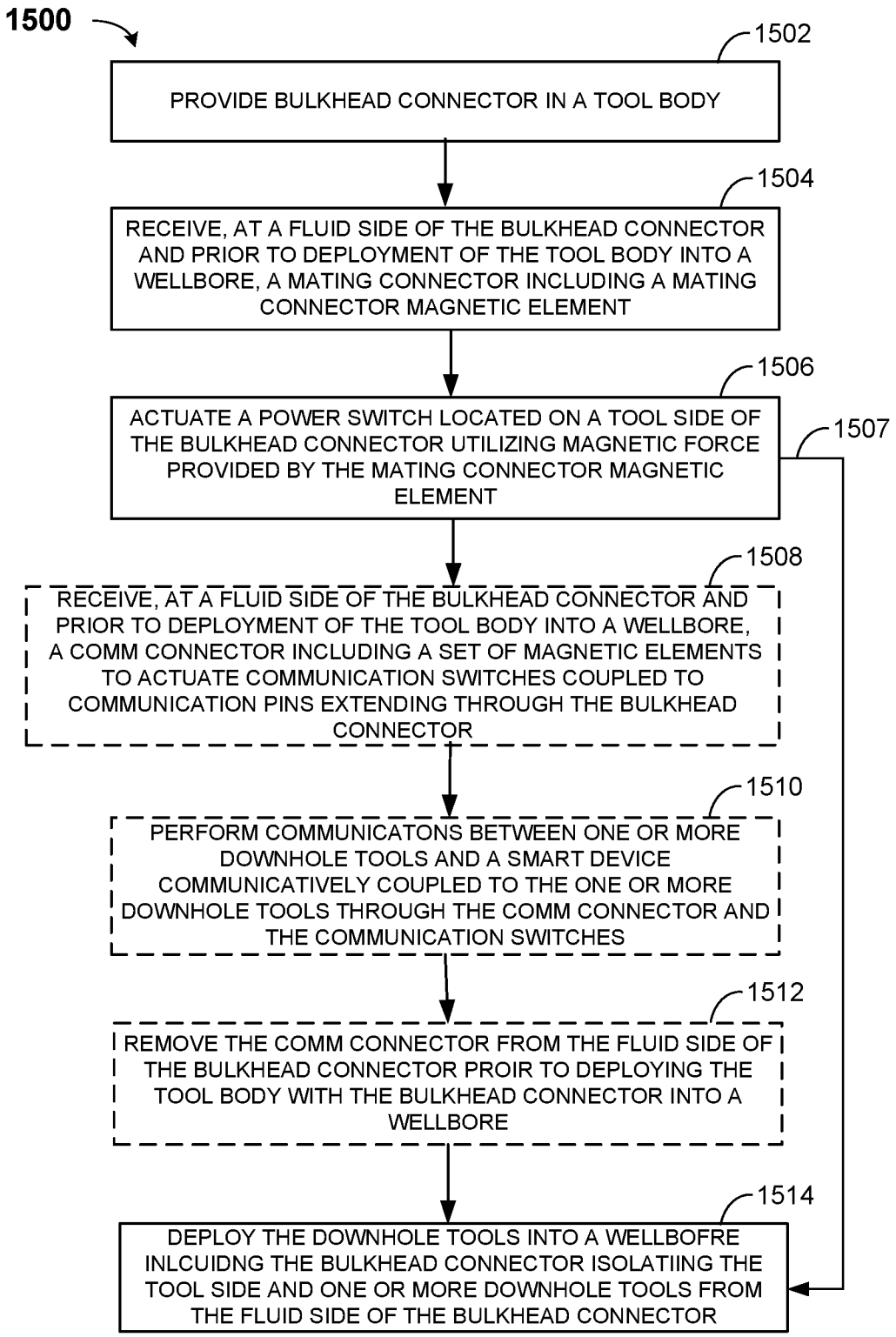
FIG. 15 illustrates one or more methods, according to one or more embodiments.

FIG. 15 illustrates one or more methods 1500, according to one or more embodiments. The embodiments of the one or more methods (hereinafter "method 1500") may be carried out using the various embodiments of a bulkhead connector, for example bulkhead connector 230 or 330, or any equivalents thereof. The bulkhead connector(s) that may be used in conjunction with the steps of method 1500 may be configured to include some combination of the fluid seals, the power switch, the communication switches, the communication pins, and/or the visual display devices described throughout this disclosure, and any equivalents thereof. Various steps included in embodiments of method 1500 may include the use of a mating connector, such as mating connector 550 as illustrated and described for example with respect to FIGS. 5A and 5B. Various steps included in embodiments of method 1500 may include the use of a comms connector, such as comms connector 790 as illustrated and described for example with respect to FIGS. 7A-7B and 8, comms connector 1190 as illustrated and described with respect to FIGS. 11A-11B, and comms connector 1190 as illustrated and described with respect to FIGS. 12A-12B.

In various embodiments, method 1500 includes providing a bulkhead connector in a tool body (block 1502). In various embodiments, the bulkhead connector is configured to provide a pressure seal between a fluid side or "high pressure side" and a tool side or "low pressure side" of the bulkhead connector. In various embodiments, the bulkhead connector includes one or more electrical switches positioned on the tool side of the bulkhead connector. The electrical switches are configured to be actuated from an "OFF" or open position to an "ON" or closed position by magnetic forces provided by one or more magnetic elements removably positioned on the fluid side of the bulkhead connector.

In various embodiments, method 1500 includes receiving at a fluid side of the bulkhead connector and prior to deployment of the tool body into a wellbore, a mating connector including a mating connector magnetic element (block 1504). In various embodiments, the mating connector is mating connector 550 and the magnetic elements is magnet as illustrated and described with respect to FIG. 5A-5B.

Referring back to FIG. 15, in various embodiments, method 1500 includes actuating a power switch located on a tool side of the bulkhead connector utilizing a magnetic force provided by the mating connector magnetic element (block 1506). In various embodiments, the magnetic force may be extended through the bulkhead connector from the fluid side to the tool side of the bulkhead connector to actuate the power switch to a closed position, thereby providing an electrical connection through the power switch.

In various embodiments, method 1500 may include receiving, at a fluid side of the bulkhead connector and prior to the deployment of the tool body including the bulkhead connector into a wellbore, a comms connector including a set of magnetic elements to actuate communication switches coupled to communication pins extending through the bulkhead connector (block 1508). In various emblements, the comms connector is comms connector 790 as illustrated and described with respect to FIGS. 7A-7B and FIG. 8. In various embodiments, the comms connector is comms connector 1190 as illustrated and described with respect to FIGS. 11A-11B, or comms connector 1290, as illustrated and described with respect to FIGS. 12A-12B.

In various embodiments, method 1500 may include performing electronic communications between or more downhole tools and a smart device communicatively coupled to the one or more downhole tools through the communication pins of the comms connector and the communication switches (block 1510). In various embodiments, communications may be performed using a laptop computer, or other smart devices coupled to the comms connector. Communications may include downloading programming and/or data to one or more of the tools positioned on the tool side of the bulkhead connector, and/or checking an operational or health status of the one or more tools.

In various embodiments, method 1500 may include removing the comms connector from the fluid side of the bulkhead connector prior to deploying the tool body with the bulkhead connector into a wellbore (block 1512).

In various embodiments, method 1500 may include deploying the downhole tools into a wellbore including the bulkhead connector isolating the tool side of the bulkhead connector and the one or more downhole tools positioned on the fluid side of the bulkhead connector from the fluid side of the bulkhead connector by the one or more seals of the bulkhead connector (block 1514). In various embodiments, deploying the downhole tools into a wellbore may include providing a bottom sub over or adject to the fluid side of the bulkhead connector to physically protect the bulkhead connector without the need to provide a fluid or pressure seal between the bottom sub and the tool body.

In various embodiments of method 1500, block 1514, including deployment of the downhole tools and the bulkhead connector, is performed following completion of activation of the power switch at block 1506, without performing the method steps described with respect to block 1508, 1510, and 1512. In alternative embodiments, method 1500 includes some combination of or all of the method steps described with respect to blocks 1508, 1510, and 1512.

Figure 16:
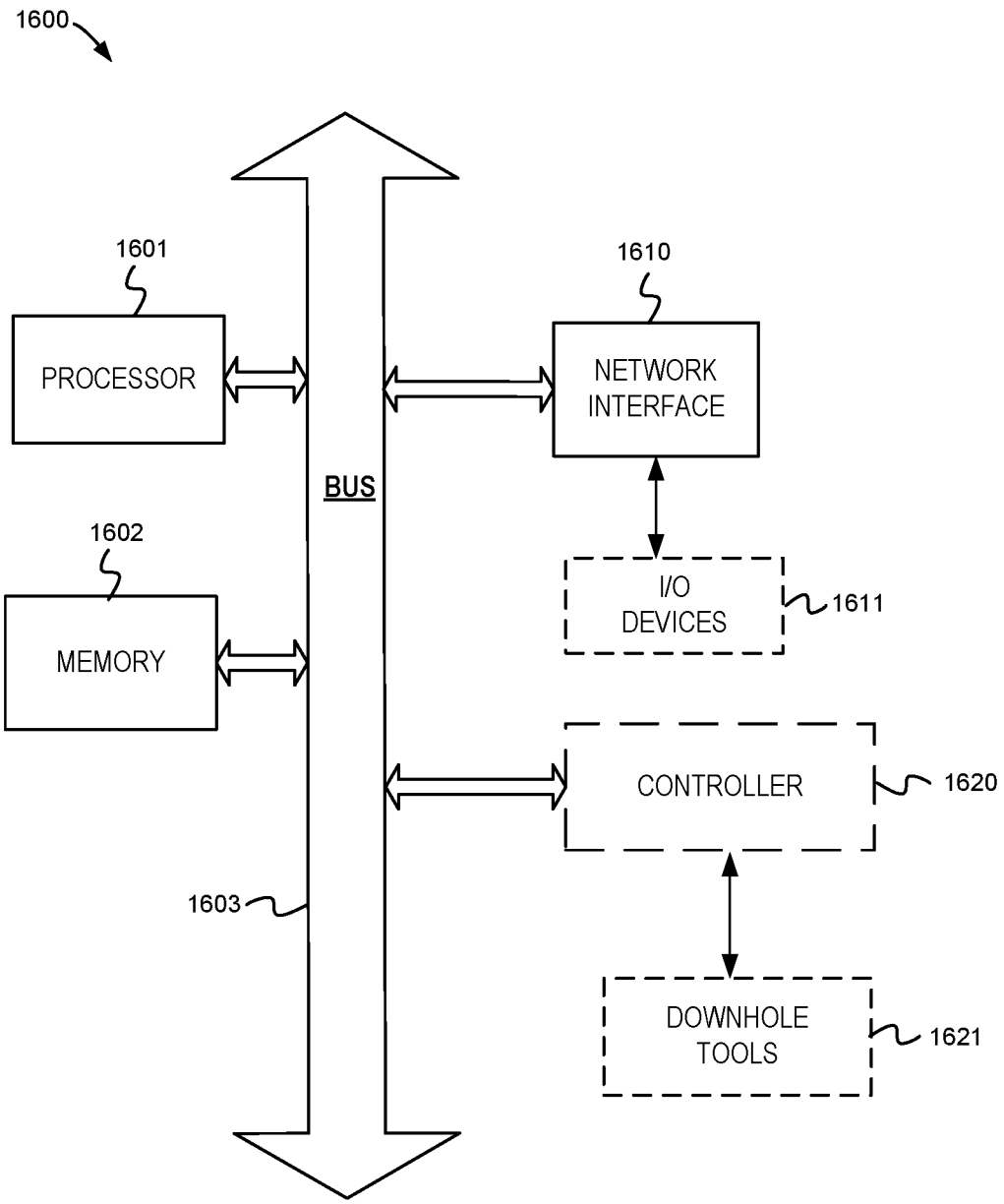
FIG. 16 illustrates a block diagram of an example computing system that may be employed in conjunction with the various embodiments of the devices and systems disclosed herein, and variations thereof.

FIG. 16 illustrates a block diagram of an example computing system 1600 that may be employed to practice the concepts, methods, and techniques disclosed herein, and variations thereof. Embodiments of computing system 1600 may be included on the tool side of a bulkhead connector installed in a tool body, the computer system incorporated into or coupled to one or more of the tools that may be located within the tool body and positioned on the tool side of the bulkhead connector. Embodiments of computing system 1600 may also be included in the devices, such as devices 405 (FIG. 4) or devices 505 (FIG. 6), which coupled for example through a comms connector to provide electronic communication with the tools included in the tool body and prior to deployment of the tool body into a wellbore.

Embodiments of computing system 1600 include a plurality of components of the system that are in electrical communication with each other using a bus 1603. The computing system 1600 may include any suitable computer, controller, or data processing apparatus capable of being programmed to carry out the method and apparatus as further described herein.

Computing system 1600 may be a general-purpose computer, and includes a processor 1601 (possibly including multiple processors, multiple cores, multiple nodes, and/or implementing multi-threading, etc.), and memory 1602. The memory 1602 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more of the possible realizations of machine-readable media. The bus 1603 is not limited to any particular type of bus or to any particular communication protocol, and may include PCI, ISA, PCI-Express, HyperTransport® bus, InfiniBand® bus, NuBus, etc. buss structure and a network interface 1610 (e.g., a Fiber Channel interface, an Ethernet interface, an internet small computer system interface, SONET interface, wireless interface, etc.).

For embodiments of computer system 1600 that are deployed downhole with the tools included in the tool body, the system may include a controller 1620 coupled to one or more of the downhole tools 1621. Controller 1620 may be configured to receive instructions, for example from processor 1601 based on the execution of programming stored in memory 1602, and provide control signal to control, oversee, and monitor the operations of the downhole tools 1621. In embodiments of the computer system 1600 that are deployed downhole, network interface 1610 may be configured to output and receive electrical signals provided over a comms connector to other devices, such as devices 405 and 505, prior to deployment of the tool body and the downhole tools into a wellbore.

In embodiments of computer system 1600 that are external to the tool body and are configured to be disconnected from the tool body prior to deploying the tool body downhole, the network interface 1610 may be configured to be coupled to and communicate with one or more of the tools located on the tool side of the bulkhead connector after the bulkhead connector has been positioned within the tool body and the pressure seals of the bulkhead connector have passed any required pressure and/or leak testing. In embodiments of computer system 1600 that are not intended to be deployed downhole, network interface 1610 may be coupled to various Input/Output (I/O) devices 1611, the I/O devices including devices such as a display screen, computer keyboard, computer mouse, and/or other input and display devices that allow a user, such as an engineer or a technician, to interact with the computer system 1600 and any devices, such as the tools located in the tool body, that may be communicatively coupled to the computer system 1600.

With respect to computing system 1600, basic features here may easily be substituted for improved hardware or firmware arrangements as they are developed. In some examples, memory 1602 includes non-volatile memory and can be a hard disk or other types of computer readable media which can store data that are accessible by a computer, such as magnetic cassettes, flash memory cards, solid state memory devices, digital versatile disks (DVDs), cartridges, RAM, ROM, a cable containing a bit stream, and hybrids thereof.

It will be understood that one or more blocks of the flowchart illustrations and/or block diagrams, and combinations of blocks in the flowchart illustrations and/or block diagrams, can be implemented by program code. The program code may be provided to a processor of a general-purpose computer, special purpose computer, or other programmable machine or apparatus. As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine. While depicted as a computing system 1600 or as a general purpose computer, some embodiments can be any type of device or apparatus to perform operations described herein.

While the aspects of the disclosure are described with reference to various implementations and exploitations, it will be understood that these aspects are illustrative and that the scope of the claims is not limited to them. Many variations, modifications, additions, and improvements are possible. Further, plural instances may be provided for components, operations or structures described herein as a single instance. Moreover, boundaries between various components and operations can be somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Unless otherwise specified, use of the terms "connect," "engage," "couple," "attach," or any other like term describing an interaction between elements is not meant to limit the interaction to direct interaction between the elements and may also include indirect interaction between the elements described. For example, antennas may be coupled inductively without touching one another. Unless otherwise specified, use of the terms "up," "upper," "upward," "up-hole," "upstream," or other like terms shall be construed as generally from the formation toward the surface, e.g., toward wellhead 106 in FIG. 1, or toward the surface of a body of water; likewise, use of "down," "lower," "downward," "downhole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis. Unless otherwise specified, use of the term "subterranean formation" shall be construed as encompassing both areas below exposed earth and areas below earth covered by water such as ocean or fresh water.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed. "Substantially" as used herein include an actual amount or location or an amount or location close thereto, e.g., within in 10% of an amount, angle, or value.

Example Embodiments

Numerous examples are provided herein to enhance understanding of the present disclosure. A specific set of example embodiments are provided as follows:

Embodiment 1. An apparatus comprising: a bulkhead connector configured to be positioned within a tool body of a completion or intervention tool for use in a wellbore and to provide a fluid seal between one or more fluids present in the wellbore and a sealed area within the tool body where one or more downhole tools are located, wherein the bulkhead connector includes one or more electrical switches positioned on a tool side of the bulkhead connector and positioned within the sealed area when the bulkhead connector is positioned with the tool body, the one or more electrical switches configured to be actuated by magnetic force(s) provided by one or more magnetic elements positioned on a fluid side of the bulkhead connector opposite the tool side.

Embodiment 2. The apparatus of embodiment 1, wherein the bulkhead connector further comprises one or more fluid seals, the one or more fluid seals configured to provide the fluid seal between the fluid side and the tool side of the bulkhead connector when the bulkhead is installed within the tool body.

Embodiment 3. The apparatus of embodiments 1 or 2, wherein the fluid side of the bulkhead connector includes a slot configured to receive a mating connector that includes a mating connector magnetic element, wherein a power switch located on the tool side of the bulkhead connector is configured to actuate to a closed position when the mating connector including the mating connector magnetic element is fully received in the slot.

Embodiment 4. The apparatus of embodiment 3, wherein the power switch is configured to electrically couple a power supply located on the tool side of the bulkhead connector to one or more downhole tools located on the tool side of the bulkhead connector when the power switch is actuated to the closed position.

Embodiment 5. The apparatus of embodiments 3 or 4, wherein the power switch includes a biasing member configured to apply a biasing force to actuate the power switch to an open position when the mating connector including the mating connector magnetic element is not fully received in the slot.

Embodiment 6. The apparatus of any one of embodiments 1-5, wherein the bulkhead connector further includes a plurality of pins that are electrically conductive and that extend through the bulkhead connector from the tool side to the fluid side of the bulkhead connector, each of the plurality of pins being electrically coupled to an individual one of the one or more electrical switches.

Embodiment 7. The apparatus of embodiment 6, wherein the fluid side of the bulkhead connector is configured to receive a comms connector that includes a plurality of receptors, each of the plurality of receptors including a corresponding comms magnet, wherein each of the plurality of receptors is electrically coupled to a corresponding comms connector lead and is configured to receive a portion of one of the plurality of pins that extends through to the fluid side of the bulkhead connector to form an electrical connection from the corresponding comms connector lead, the corresponding receptor and the pin coupled to the corresponding receptor and through the bulkhead connector to a corresponding one of the one or more electrical switches positioned on the tool side of the bulkhead connector.

Embodiment 8. The apparatus of embodiment 7, wherein the corresponding comms magnet is configured to exert a magnetic force through the bulkhead connector in order to actuate a corresponding one of the one or more electrical switches from an open to a closed position when the comms connector including the corresponding comms magnet is received at the fluid side of the bulkhead connector.

Embodiment 9. The apparatus of embodiments 7 or 8, wherein the comms connector is configured to provide one or more electrical communication connections between a smart device coupled to one or more comms leads of the comms connector and one or more devices included on the tool side of the bulkhead connector.

Embodiment 10. The apparatus of any one of embodiments 1-9, wherein the bulkhead connector is configured to receive a comms connector at the fluid side of the bulkhead connector, the comms connector configured to provide one or more electrical communication pathways between one or more devices coupled to the comms connector and one or more devices positioned on the tool side of the bulkhead connector, and to allow removal of the comms connector without disturbing the fluid seal between the bulkhead connector and the tool body.

Embodiment 11. A method comprising: providing a bulkhead connector in a tool body, the bulkhead connector comprising one or more seals configured to provide a fluid seal between a tool side of the bulkhead connector and a fluid side of the bulkhead connector when the tool body is deployed in a wellbore, the bulkhead connector comprising one or more electrical switches positioned on the tool side of the bulkhead connector; prior to deploying the tool body in the wellbore, the method further comprising: receiving, at a slot provided on the fluid side of the bulkhead connector, a mating connector including a mating connector magnetic element; and actuating a power switch of the one or more electrical switches using a magnetic force provided by the mating connector magnetic element, the magnetic force exerted through the bulkhead connector, wherein actuating the power switch includes providing an electrical connection between a power supply positioned on the tool side of the bulkhead connector and one or more downhole tools positioned on the tool side of the bulkhead connector to electrically power the one or more downhole tools through the power switch.

Embodiment 12. The method of embodiment 11, further comprising: prior to the tool body being deployed downhole in the wellbore, actuating one or more communication switches positioned on the tool side of the bulkhead connector by providing a comms connector on the fluid side of the bulkhead connector, each of the one or more communication switches configured to, when actuated, provide an electrical connection between one or more electrical devices included on the tool side of the bulkhead connector and an individual one of a plurality of communication pins extending through the bulkhead connector from the tool side to the fluid side of the bulkhead connector.

Embodiment 13. The method of embodiment 12, wherein the comms connector comprises a set of individual magnetic elements, each of the individual magnetic elements corresponding to a respective one of the one or more communication switches, wherein actuating the one or more communication switches comprises exerting a magnetic force provided by each one of the set of individual magnetic elements onto a respective one of the one or more communication switches through the bulkhead connector in order to activate each of the one or more communication switches to an closed position providing and electrical connection across each the respective one or more communication switches.

Embodiment 14. The method of embodiments 12 or 13, further comprising: generating an output signal from the one or more downhole tools positioned on the tool side of the bulkhead connector while the one or more tools are being powered through the power switch located on the tool side of the bulkhead connector; and providing the output signal through the plurality of communication pins to at least one visual display device located on the comms connector, the visual display device providing a visual output based on the output signal, the visual output indicative of one or more statuses associated with the one or more downhole tools.

Embodiment 15. The method of any one of embodiments 12-14, further comprising: while the one or more communication switches are actuating, performing electrical communications between the one or more electrical devices included on the tool side of the bulkhead and a smart device positioned on the fluid side of the bulkhead connector and coupled to the one or more electrical devices through the plurality of communication pins and the one or more communication switches.

Embodiment 16. The method of embodiment 15, wherein external electrical power is provided and wherein the electrical communications are performed prior to the mating connector being received at the slot on the fluid side of the bulkhead and prior to powering the downhole tools through the power switch.

Embodiment 17. The method of embodiments 15 or 16, further comprising: upon completion of the electrical communications, removing the comms connector from the fluid side of bulkhead connector, thereby deactivating the one or more communication switches, wherein deactivating the one or more communication switches causes each of the one or more communicate switch to move to an open position and break the electrical connections between the one or more electrical devices included on the tool side of the bulkhead connector and the plurality of communication pins.

Embodiment 18. The method of any one of embodiment 11-17, further comprising: deploying the tool body, including the bulkhead connector and the mating connector received at the slot of the bulkhead connector, downhole into the wellbore, and performing one or more downhole operations utilizing the one or more downhole tools while the downhole tools are deployed within the wellbore and while the downhole tools are being powered through the electrical connection provided through the power switch.

Embodiment 19. A system comprising: a completion or intervention tool configured to be positioned in a wellbore, the completion or intervention tool comprising: a bulkhead connector configured to be positioned within a tool body of a completion or intervention tool for use in the wellbore and to provide a fluid seal between one or more fluids present in the wellbore and a sealed area within the tool body where one or more downhole tools are located, wherein the bulkhead connector includes one or more electrical switches positioned on a tool side of the bulkhead connector and positioned within the sealed area when the bulkhead connector is positioned with the tool body, the one or more electrical switches configured to be actuated by magnetic force(s) provided by one or more magnetic elements positioned on a fluid side of the bulkhead connector opposite the tool side.

Embodiment 20. The system of embodiment 19, wherein the bulkhead connector further comprises a plurality of pins that are electrically conductive and that extend through the bulkhead connector from the tool side to the fluid side of the bulkhead connector, each of plurality of pins being electrically coupled to an individual one of the one or more electrical switches, the plurality pins configured to provide an electrical communication pathway between a comms connector received at the fluid side of the bulkhead connector and one or more devices located on the tool side of the bulkhead connector prior to deployment of the completion or intervention tool into the wellbore and without disturbing the fluid seal.

What is claimed is:

1. An apparatus comprising:

a bulkhead connector configured to be positioned within a tool body of a completion or intervention tool for use in a wellbore and to provide a fluid seal between one or more fluids present in the wellbore and a sealed area within the tool body where one or more downhole tools are located, wherein the bulkhead connector includes one or more electrical switches positioned on a tool side of the bulkhead connector and positioned within the sealed area when the bulkhead connector is positioned with the tool body, the one or more electrical switches configured to be actuated by magnetic force(s) provided by one or more magnetic elements positioned on a fluid side of the bulkhead connector opposite the tool side, and wherein the fluid side of the bulkhead connector includes a slot configured to receive a mating connector that includes a mating connector magnetic element, wherein a power switch located on the tool side of the bulkhead connector is configured to actuate to a closed position when the mating connector including the mating connector magnetic element is fully received in the slot.

2. The apparatus of claim 1, wherein the bulkhead connector further comprises one or more fluid seals, the one or more fluid seals configured to provide the fluid seal between the fluid side and the tool side of the bulkhead connector when the bulkhead is installed within the tool body.

3. The apparatus of claim 1, wherein the bulkhead connector is configured to receive a comms connector at the fluid side of the bulkhead connector, the comms connector configured to provide one or more electrical communication pathways between one or more devices coupled to the comms connector and one or more devices positioned on the tool side of the bulkhead connector, and to allow removal of the comms connector without disturbing the fluid seal between the bulkhead connector and the tool body.

4. The apparatus of claim 1, wherein the power switch is configured to electrically couple a power supply located on the tool side of the bulkhead connector to one or more downhole tools located on the tool side of the bulkhead connector when the power switch is actuated to the closed position.

5. The apparatus of claim 1, wherein the power switch includes a biasing member configured to apply a biasing force to actuate the power switch to an open position when the mating connector including the mating connector magnetic element is not fully received in the slot.

6. The apparatus of claim 1, wherein the bulkhead connector further includes a plurality of pins that are electrically conductive and that extend through the bulkhead connector from the tool side to the fluid side of the bulkhead connector, each of the plurality of pins being electrically coupled to an individual one of the one or more electrical switches.

7. The apparatus of claim 6, wherein the fluid side of the bulkhead connector is configured to receive a comms connector that includes a plurality of receptors, each of the plurality of receptors including a corresponding comms magnet, wherein each of the plurality of receptors is electrically coupled to a corresponding comms connector lead and is configured to receive a portion of one of the plurality of pins that extends through to the fluid side of the bulkhead connector to form an electrical connection from the corresponding comms connector lead, the corresponding receptor and the pin coupled to the corresponding receptor and through the bulkhead connector to a corresponding one of the one or more electrical switches positioned on the tool side of the bulkhead connector.

8. The apparatus of claim 7, wherein the corresponding comms magnet is configured to exert a magnetic force through the bulkhead connector in order to actuate a corresponding one of the one or more electrical switches from an open to a closed position when the comms connector including the corresponding comms magnet is received at the fluid side of the bulkhead connector.

9. The apparatus of claim 7, wherein the comms connector is configured to provide one or more electrical communication connections between a smart device coupled to one or more comms leads of the comms connector and one or more devices included on the tool side of the bulkhead connector.

10. A method comprising:

providing a bulkhead connector in a tool body, the bulkhead connector comprising one or more seals configured to provide a fluid seal between a tool side of the bulkhead connector and a fluid side of the bulkhead connector when the tool body is deployed in a wellbore, the bulkhead connector comprising one or more electrical switches positioned on the tool side of the bulkhead connector;

prior to deploying the tool body in the wellbore, the method further comprising:

receiving, at a slot provided on the fluid side of the bulkhead connector, a mating connector including a mating connector magnetic element; and actuating a power switch of the one or more electrical switches using a magnetic force provided by the mating connector magnetic element, the magnetic force exerted through the bulkhead connector, wherein actuating the power switch includes providing an electrical connection between a power supply positioned on the tool side of the bulkhead connector and one or more downhole tools positioned on the tool side of the bulkhead connector to electrically power the one or more downhole tools through the power switch.

11. The method of claim 10, further comprising:

deploying the tool body, including the bulkhead connector and the mating connector received at the slot of the bulkhead connector, downhole into the wellbore, and performing one or more downhole operations utilizing the one or more downhole tools while the downhole tools are deployed within the wellbore and while the downhole tools are being powered through the electrical connection provided through the power switch.

12. The method of claim 10, further comprising:

prior to the tool body being deployed downhole in the wellbore, actuating one or more communication switches positioned on the tool side of the bulkhead connector by providing a comms connector on the fluid side of the bulkhead connector, each of the one or more communication switches configured to, when actuated, provide an electrical connection between one or more electrical devices included on the tool side of the bulkhead connector and an individual one of a plurality of communication pins extending through the bulkhead connector from the tool side to the fluid side of the bulkhead connector.

13. The method of claim 12, wherein the comms connector comprises a set of individual magnetic elements, each of the individual magnetic elements corresponding to a respective one of the one or more communication switches, wherein actuating the one or more communication switches comprises exerting a magnetic force provided by each one of the set of individual magnetic elements onto a respective one of the one or more communication switches through the bulkhead connector in order to activate each of the one or more communication switches to an closed position providing and electrical connection across each the respective one or more communication switches.

14. The method of claim 12, further comprising:

generating an output signal from the one or more downhole tools positioned on the tool side of the bulkhead connector while the one or more tools are being powered through the power switch located on the tool side of the bulkhead connector; and providing the output signal through the plurality of communication pins to at least one visual display device located on the comms connector, the visual display device providing a visual output based on the output signal, the visual output indicative of one or more statuses associated with the one or more downhole tools.

15. The method of claim 12, further comprising:

while the one or more communication switches are actuating, performing electrical communications between the one or more electrical devices included on the tool side of the bulkhead and a smart device positioned on the fluid side of the bulkhead connector and coupled to the one or more electrical devices through the plurality of communication pins and the one or more communication switches.

16. The method of claim 15, wherein external electrical power is provided and wherein the electrical communications are performed prior to the mating connector being received at the slot on the fluid side of the bulkhead and prior to powering the downhole tools through the power switch.

17. The method of claim 15, further comprising:

upon completion of the electrical communications, removing the comms connector from the fluid side of bulkhead connector, thereby deactivating the one or more communication switches, wherein deactivating the one or more communication switches causes each of the one or more communicate switch to move to an open position and break the electrical connections between the one or more electrical devices included on the tool side of the bulkhead connector and the plurality of communication pins.

18. A system comprising:

a completion or intervention tool configured to be positioned in a wellbore, the completion or intervention comprising:

a bulkhead connector configured to be positioned within a tool body of a completion or intervention tool for use in the wellbore and to provide a fluid seal between one or more fluids present in the wellbore and a sealed area within the tool body where one or more downhole tools are located, wherein the bulkhead connector includes one or more electrical switches positioned on a tool side of the bulkhead connector and positioned within the sealed area when the bulkhead connector is positioned with the tool body, the one or more electrical switches configured to be actuated by magnetic force(s) provided by one or more magnetic elements positioned on a fluid side of the bulkhead connector opposite the tool side, and wherein the fluid side of the bulkhead connector includes a slot configured to receive a mating connector that includes a mating connector magnetic element, wherein a power switch located on the tool side of the bulkhead connector is configured to actuate to a closed position when the mating connector including the mating connector magnetic element is fully received in the slot.

19. The system of claim 18, wherein the bulkhead connector further comprises a plurality of pins that are electrically conductive and that extend through the bulkhead connector from the tool side to the fluid side of the bulkhead connector, each of plurality of pins being electrically coupled to an individual one of the one or more electrical switches, the plurality pins configured to provide an electrical communication pathway between a comms connector received at the fluid side of the bulkhead connector and one or more devices located on the tool side of the bulkhead connector prior to deployment of the completion or intervention into the wellbore and without disturbing the fluid seal.

* * * * *